US011384534B2

(12) United States Patent
Edscer et al.

(10) Patent No.: US 11,384,534 B2
(45) Date of Patent: Jul. 12, 2022

(54) BUILDING REINFORCEMENT AND INSULATION

(71) Applicant: William George Edscer, East Sussex (GB)

(72) Inventors: William George Edscer, East Sussex (GB); John Jones, East Sussex (GB)

(73) Assignee: William George Edscer, East Sussex (GB)

( * ) Notice: Subject to any disclaimer, the term of this patent is extended or adjusted under 35 U.S.C. 154(b) by 38 days.

(21) Appl. No.: 16/981,906

(22) PCT Filed: Mar. 19, 2019

(86) PCT No.: PCT/GB2019/050766
§ 371 (c)(1),
(2) Date: Sep. 17, 2020

(87) PCT Pub. No.: WO2019/180421
PCT Pub. Date: Sep. 26, 2019

(65) Prior Publication Data

US 2021/0115667 A1 Apr. 22, 2021

(30) Foreign Application Priority Data

Mar. 20, 2018 (GB) ..... 1804422
Aug. 28, 2018 (GB) ..... 1813965

(51) Int. Cl.
*E04B 2/94* (2006.01)
*E04B 1/04* (2006.01)
(Continued)

(52) U.S. Cl.
CPC ..... *E04B 2/94* (2013.01); *E04B 1/043* (2013.01); *E04B 1/215* (2013.01); *E04F 13/08* (2013.01)

(58) Field of Classification Search
CPC .. E04B 2/94; E04B 1/043; E04B 1/215; E04F 13/0803; E04F 13/0805; E04F 13/08
See application file for complete search history.

(56) References Cited

U.S. PATENT DOCUMENTS 4,060,951 A * 12/1977 Gere ..... E04B 2/94 52/508
2006/0075714 A1 4/2006 Simmons
(Continued)

FOREIGN PATENT DOCUMENTS

CH 663813 A5 * 1/1988 ..... E04B 2/94
CN 206091171 U 4/2017
(Continued)

OTHER PUBLICATIONS

International Search Report (Form PCT/ISA/210) for International Patent Application No. PCT/GB2019/050766, issued from the European Patent Office, dated Jun. 19, 2019, 3 pages.
(Continued)

*Primary Examiner* — Christine T Cajilig
(74) *Attorney, Agent, or Firm* — Kilyk & Bowersox, P.L.L.C.

(57) ABSTRACT

A method is provided for securing external wall insulation (EWI) panels to the outer walls of a high rise building of large panel construction. The method involves first identifying the location of internal voids in outermost floor/ceiling panels of the building; and then creating continuous passages through the outer load-bearing wall panels of the building into the located internal voids, with each such passage forming a tie bar anchorage hole extending into the adjacent floor/ceiling panel. Down the length of each tie bar anchorage hole is inserted a tie bar that has, at an inner end portion, an anchorage, and at an outer end portion, an externally screw-threaded portion that projects from the outer load-bearing wall panel. A pattress plate is located at
(Continued)

the outer end of each anchorage hole, with the externally screw-threaded outer end portion of each tie bar extending through the associated pattress plate.

17 Claims, 15 Drawing Sheets

(51) Int. Cl.
*E04B 1/21* (2006.01)
*E04F 13/08* (2006.01)

(56) References Cited

U.S. PATENT DOCUMENTS

2006/0230696 A1* 10/2006 Sarkkinen ..... E04B 5/43 52/223.6
2016/0153198 A1* 6/2016 Hatzinikolas ..... E04F 13/0805 52/702
2020/0141110 A1* 5/2020 Guo ..... E04C 3/26

FOREIGN PATENT DOCUMENTS

FR 2291324 A1 * 6/1976 ..... E04B 2/94
GB 1256313 12/1971
GB 1256313 A * 12/1971 ..... E04B 1/2612
JP H11124980 A 5/1999
NL 1019055 C1 3/2003
NL 2017629 B1 4/2018
WO WO-2013173887 A2 * 11/2013

OTHER PUBLICATIONS

Written Opinion of the International Searching Authority (Form PCT/ISA/237) for International Patent Application No. PCT/GB2019/050766, issued from the European Patent Office, dated Jun. 19, 2019, 5 pages.
Combined Search and Examination Report for Great Britain Application No. GB1903748.0, published by the United Kingdom Intellectual Property Office, dated Sep. 18, 2019, 5 pages.
Search Report for Application No. GB1813965.9, published by the United Kingdom Intellectual Property Office, dated Nov. 23, 2018, 3 pages.

* cited by examiner

BUILDING REINFORCEMENT AND INSULATION

FIELD OF THE INVENTION

The invention relates to a method of reinforcing and insulating a certain class of existing high rise modular building. The buildings to be reinforced and insulated in this way are all concrete frame buildings, but the method is most advantageously applied to large panel system buildings. These are systems in which load-bearing precast concrete wall slabs are erected edge to edge and topped with precast concrete floor/ceiling slabs which are secured edge to edge to the tops of the load-bearing wall slabs. Each floor/ceiling slab forms part of the ceiling of the storey defined by the interconnected wall slabs and part of the floor of the next higher storey of the building. One well documented collapse of such a large panel system high rise building in the United Kingdom was the partial collapse of the Ronan Point tower block in 1968, when an internal gas explosion blew out part of an external wall, leading to the disproportionate collapse of one corner of the tower block. It is understood that the partial collapse of the building became disproportionate in part because the outer walls and many of the floor/ceiling slabs immediately above the explosion were no longer supported by the external wall blown out by the explosion, and in part because the weight of falling masonry brought down the outer walls and many floor/ceiling slabs of the storeys immediately beneath the damaged load-bearing external wall. The damage to the building therefore extended both above and below the explosion site.

A more recent high rise tower block tragedy in the United Kingdom was the Grenfell Tower fire in 2017, when a fire swept upwardly through a tower block, feeding principally, it is believed, through the external wall insulation ("EWI") panels that had been added as cladding over the external walls of the building.

Despite the Grenfell Tower fire tragedy, it is still desirable to face tower block buildings with EWI panels to improve their thermal insulation and appearance. This invention is based on the observation that however close the external cladding panel is to the large panel external wall of the building on which it is hung, there is inevitably a cantilever effect pulling the large panel external wall away from the building. Therefore, hanging EWI panels on the outside of a large panel building increases the possibility of disproportionate collapse of the building if an external large panel wall should be damaged. This increased possibility of disproportionate collapse is at its greatest when the EWI panels are heavy panels, such as precast concrete EWI panels, but still exists even when the EWI panels are lightweight panels such as those based on the use of mineral wool which has a nil fire rating.

It is an object of this invention to provide a method of securing EWI panels to concrete frame buildings, and particularly to large panel system buildings, while simultaneously adding to the structural strength and integrity of the buildings to reduce the risk of disproportionate collapse should there be an internal explosion or other cause of structural failure of any of the EWI-clad external load-bearing walls.

SUMMARY OF THE INVENTION

The invention provides the method of claim 1 herein. The method can be considered as comprising four main stages:

creating the tie bar anchorage holes through the external wall panels on which the EWI panels are to be added as cladding and into the adjacent outermost floor/ceiling panels of the building;

securing in position the tie bars and pattress plates;

building the metal framework bolted to the exposed threaded ends of the tie bars; and securing to the metal framework the EWI panels to clad the building and enhance the thermal insulation of the building.

In the first of the above four stages, the continuous passages which form the tie bar anchorage holes are preferably drilled as core holes from the outside of the building. The accurate location of the drilling of the core holes is paramount. They are to be the start of the tie bar anchorage holes which extend some considerable depth into the adjacent floor/ceiling panels, and yet the edges of the floor/ceiling panels are not visible from the outside of the building. Much can be learned from the original building plans which ought to show the full specification and location of the floor/ceiling panels. In the case of large panel system buildings, the floor/ceiling panels are precast panels which may be solid reinforced concrete panels or may be formed with axially elongate voids to reduce the overall weight of individual panels. In the case of other concrete frame buildings the floor/ceiling panels may have been cast in situ as solid reinforced concrete over temporary shuttering. In either case the location of the reinforcing steel bars should be identified for example by carrying out a three-dimensional imaging survey of the floor/ceiling panels, so that the internal steel reinforcement can be avoided during the drilling of the tie bar anchorage holes. But more than that: if the floor/ceiling panels are precast panels with axially elongate internal voids, then the location, size and shape of those voids should be known in order for the tie rod anchorage holes to take maximum advantage of those voids. The location or approximate location of the voids may initially be established from the building plans and possibly from an X-ray scan of the building taken through the outer walls. Preferably a series of pilot holes is drilled through the load-bearing outer walls and into one or more of those voids, so that the size and shape of the voids may be established with precision, for example using a bore scope. If the axial voids extend perpendicularly to the outer wall through which the core holes are drilled, then careful alignment of those core holes with the ends of the voids can ensure that the core holes and voids together form the tie bar anchorage holes which extend into the floor/ceiling panels for the necessary depth. If the axial voids extend other than perpendicularly, for example parallel to the outer wall panel or diagonally thereto, then the core holes must be drilled into the floor/ceiling panels across a number of voids, by drilling through the concrete walls separating the axial voids until the desired depth of each tie bar anchorage hole is achieved. That depth is at least 300 mm, advantageously more than three metres and preferably more than four metres.

If the floor/ceiling panels are solid concrete without the above internal voids, then the core drilling through the outer wall panels is simply continued through the floor/ceiling panels until the necessary depth of tie bar anchorage hole is achieved.

If the pattress plates are (in the second of the above four stages) to be secured against the outer faces of the load-bearing wall panels, then those core holes are simple core holes less than the size of the pattress plates, drilled from the outer faces of the wall panels into the adjacent floor/ceiling panels. Generally, however in a large panel system building the wall panels comprise inner and outer leaves separated by an insulating layer, in which case the inner leaf is the load-bearing element which supports the adjacent floor/ceiling panel. In that case the core holes drilled from the outer face of the wall panels are pattress core holes sized to receive the pattress plates, and the pattress plates are preferably secured within those pattress core holes to bear against the inner load-bearing leaves of the wall panels. In such a case the drilling of the core holes commences with the drilling of pattress core holes from the outside faces of the wall panels as far as the inner leaves of the wall panels, so that when the pattress plates are inserted into those core holes they bear against the inner leaves. Preferably those pattress core holes are of a diameter to receive as a close fit cylindrical pattress plates, and are drilled to a depth to receive the cylindrical pattress plates fully within the pattress core holes so that the pattress plates do not project from the outer faces of the wall panels.

The second of the above four stages is to secure in position the tie bars and the pattress plates. Each tie bar preferably has a length of at least 300 mm, advantageously more than three metres and preferably more than four metres, so that it can extend well into the associated tie bar anchorage hole, and has at one end portion an anchorage such as a washer of substantially the same size and shape as the tie bar anchorage hole. That washer may for example be secured to the tie bar by cutting or rolling a screw thread at the inner end portion of each tie bar, passing the washer over that threaded inner end portion and clamping the washer against a shoulder of the tie bar with a nut. The tie bar is then inserted down the associated tie bar anchorage hole until only the externally screw-threaded outer end of the tie bar extends from the outer wall panel. Preferably before insertion of each tie bar down its anchorage hole a fabric sleeve is placed around at least the inner end portion of the tie bar so that when the tie bar is pushed down the anchorage hole it carries with it the fabric sleeve. Wire spacers may be provided at intervals along the length of the tie bars to hold the tie bars generally centrally in the tie bar anchorage holes in the floor/ceiling panels and to hold the fabric sleeves apart from the tie bars to encourage the flow of grout, in the next step of the method, down the full length of the tie bars.

After insertion of the tie bars in the tie bar anchorage holes, a pattress plate is placed over the projecting outer end of each tie bar. Each pattress plate has an aperture through which the externally screw-threaded outer end portion of the tie bar passes. When the pattress plates are received in pattress core holes formed in the wall panels, they are preferably recessed to a depth so that their outer faces lie flush with or do not project from the outer faces of the wall panels. The pattress plates may be of unitary construction, in which case the depth of the pattress core holes is preferably accurately controlled so that when the inner face of each pattress plate abuts the end of its pattress core hole the outer face of that pattress plate lies flush with or do not project from the outer face of the outer leaf of the wall panel. That, however, requires very accurate depth control in the drilling of the pattress core holes, and it is therefore often preferable to form the pattress plates as two axially spaced elements, an inner element and an outer element. The inner element is the element which bears against the end of its pattress core hole to restrain that wall panel from any outward movement which could potentially relinquish support for the adjacent floor/ceiling panel. The outer element is subsequently adjusted, as described below, to bring it into the desired planar alignment with the outer face of the outer leaf of the wall panel.

In the case of circular pattress plates located in pattress core holes, the aperture through which the externally screw-threaded outer end portion of the tie bar passes may be central, or may be slightly offset from centre to receive the externally screw-threaded outer end portion of the tie bar if that end portion should be slightly off-centre (for example due to slight sagging of the tie bar over its length). If desired, the aperture may be elongate, extending radially outwards from the axial centre of each such circular pattress plate so that by rotating the pattress plate in its pattress core hole that aperture can be aligned with the end of the tie bar even if the tie bar has sagged so that its end is no longer axially central of the pattress core hole. Further rotation of the pattress plate can then if desired lift the end of the tie bar to an axial centre. An alternative method of bringing the aperture in the pattress plate into alignment with a potentially misaligned projecting end of the tie bar is for the pattress plate or pattress plate element to be made as inner and outer rings, one rotatable relative to the other about an eccentric axis. The aperture through which the externally screw-threaded outer end portion of the tie bar passes is a preferably eccentric aperture in the inner ring so that rotation of the inner and/or outer ring moves the aperture in an orbital path and the rotation can be adjusted until the aperture is aligned with the projecting end of the tie bar.

To complete this second stage in the method of the invention, the tie bars and pattress plates are firmly anchored in place using a grouting compound. Each pattress plate should be held in position, for example with a nut threaded onto the projecting end of the associated tie bar or by a screw thread of the pattress plate itself. Then grout is extruded into the tie bar anchorage holes, past the pattress plate or pattress plate element or through an eccentric grout hole in each pattress plate or pattress plate element. In order to fill the tie bar anchorage holes completely with grout, and in order to exclude any air pockets, the grout is preferably injected down a flexible injection tube which passes past the pattress plate or pattress plate element or through the eccentric grout hole in the pattress plate or pattress plate element and extends right down to the anchorage ends of the tie bars. The tie bar anchorage holes are therefore filled with grout from the innermost ends, and the flexible injection tube is preferably removed during the grout injection. In this second of the above four stages it may be desirable to ensure that each tie bar is held in place in its tie bar anchorage hole with a preliminary extrusion of some of the grouting compound around the anchorage at the innermost end of the tie bar, allowing that grouting compound to set or partially set, to hold the tie bar in place before proceeding. The grouting compound may be cementitious or resinous and is forced past the pattress plates or through the grout holes in the pattress plates until it fills the space between the tie bars and the tie bar anchorage hole internal walls. If the tie bars are surrounded or partially surrounded by fabric sleeves, then the grouting compound is extruded into the tie bar anchorage holes between the tie bars and the sleeves and, permeating through the fabric of the sleeves, bonds to the concrete of the associated floor/ceiling panel. The sleeves prevent wastage of the grouting compound by restricting its flow into voids in the floor/ceiling slabs.

Whatever method is used to fill the tie bar anchorage holes with grout, it is desirable to be able to confirm that no voids have been left within the anchorage holes during the grouting process. Preferably when the grout has set sufficiently, the pattress plate is removed from the tie bar and a visible inspection carried out to confirm that the grout completely fills the anchorage holes before the pattress plate is once again placed in position on the threaded outer end of the tie bar.

Once the grouting compound has set, the tie bars and pattress plates are securely anchored to the building structure. Preferably the tie bars are made from deformed steel reinforcing bar stock, so that the anchorage is very secure and strong. After this stage of the process is completed there is preferably a period of waiting, for example of 7 to 14 days, for the grouting compound to set fully. Preferably the security of the tie anchorage is tested after this period to demonstrate that it resists a pull-out test using a test force which depends on the engineer's design. That should be sufficient to show that the tie bars are firmly anchored in place in the anchorage holes in the floor/ceiling slabs and the pattress plates are firmly anchored in place in the pattress core holes formed in the wall slabs. Then the pattress plates can be firmly secured to the tie bars by tightening to a desired torque rating a holding nut threaded onto the projecting end of each tie bar.

If the pattress plates comprise inner and outer elements of which the outer element is adjustable so as to bring its outer face precisely flush with or slightly recessed relative to the outer face of the associated wall panel, then all that has been described above concerning the anchorage of the pattress plates should be read as describing the anchorage of the inner element of the composite pattress plate. The outer element is subsequently placed over the projecting threaded end of the tie bar and adjusted to bring it into the desired alignment with the outer face of the wall panel. That adjustment may be by placing spacers and/or shim washers on the projecting end of the tie bar before placing the pattress plate outer element in position, to bridge an axial gap between the inner and outer elements of the pattress plate and to bring the outer element of the pattress plate into the desired planar alignment with the outer leaf of the wall panel, or it may be by having the outer element of the pattress plate screw-threaded onto the threaded end of the tie bar so that rotation of that outer element of the pattress plate can cause it to be moved outwardly or inwardly until it achieves the desired accurate planar alignment. Preferably any space between inner and outer elements of such a composite pattress plate is filled with a cementitious or resinous grout before the second of the above four stages is complete.

The next stage in the method is the securing of a metal framework to the exposed ends of the tie bars. Brackets may be formed integrally with the pattress plates, and if so the pattress plates are secured firmly to the tie bars by retention nuts threaded onto the externally screw-threaded outer ends of the tie bars and tightened to a desired torque rating. The metal framework is subsequently secured to those integral brackets. If the pattress plates have no such integral brackets, then initially separate mounting elements are placed over the projecting threaded ends of the tie bars and secured in place with retention nuts which are threaded onto the externally screw-threaded outer ends of the tie bars and ultimately tightened to the desired torque rating. Each mounting element comprises a plate portion which in use lies flat against and bears against the outer surface of the associated pattress plate. Each plate portion is provided with a mounting hole, which may be round or elongated, through which the externally threaded end portion of the associated tie bar extends before receiving the retention nut. The core holes should have been drilled in a vertical and horizontal array, but those mounting holes may be sized for final adjustment of the mounting elements and their supported metal framework to improve and perfect the vertical and horizontal alignment before tightening the retention nuts. Before that final tightening, to each bracket or mounting element is secured a rail of the metal framework, and the framework is built up on site by connection together of vertical and horizontal rails. Preferably the vertical rails are first secured to the brackets or mounting elements, and the horizontal rails subsequently secured to the vertical rails. The vertical rails may be in flush contact with the outer faces of the wall slab or may be spaced slightly from those outer faces with a spacing (for example 5 to 10 mm) deemed desirable and acceptable by a structural engineer. If desired such a spacing may be bridged at intervals with metal shims or plates contacting both the outer wall of the building and the vertical rails. That alignment or spacing can be easily controlled when the pattress plates have been recessed into pattress core holes in the wall panels and precisely adjusted until their outer faces are flush with or marginally recessed relative to the outer faces of the wall panels.

If the pattress plates have integral brackets or if the mounting elements have similar brackets extending from their plate portions, then flange portions of those brackets are preferably oriented vertically to carry vertical rails of the metal framework. Those vertical rails may be arranged in pairs, back to back one on each side of the flange portions of the brackets, and secured to the brackets by bolts, rivets or other securing means. If the pattress plates do not have integral brackets, then the plate portions of the mounting elements may alternatively have tapped mounting holes so that the vertical rails can be attached directly to the mounting elements by set screws.

Vertically adjacent vertical rails of the metal framework are preferably connected to each other by plates which span pairs of adjacent vertically aligned rails. Such plates are preferably first bolted to one vertical rail through pre-drilled holes and then connected to the adjacent rail by bolts passing through holes drilled in situ through both the plate and the adjacent vertical rail. The in-situ drilling is a means of ensuring that a very precise spacing of the vertical rails can be achieved when the rails have been adjusted to an accurate vertical alignment.

Horizontal metal rails are secured to the array of parallel vertical rails to complete the metal framework. Additional diagonal bars may be added, to improve the rigidity of the metal framework.

Each retention nut secures its bracket or mounting element to the associated tie bar, and after accurate alignment of the metal framework the retention nuts may be tightened to a desired torque rating to avoid further movement. The torque applied may itself be sufficient to prevent loosening of the framework over time, or additional means may be employed to achieve that end. For example, the retention nuts may be self-locking nuts; or they may be capped by locking nuts which are applied and tightened after the framework is in place; or they may be castellated nuts held against rotation by anchor pins; or the tightened retention nuts may be sprayed with a galvanizing coating which acts both to prevent rusting of the threaded joint and to prevent the retention nuts from slackening over time.

At the completion of this third stage in the method of the invention, the metal framework is securely and accurately anchored to the face of the large panel building. The final step of the method is to hang EWI panels on that framework. Any secure fixing method may be used, consistent with the precise EWI panels chosen. The EWI panels may be concrete external cladding panels with fire resistant thermal insulation or may be more lightweight thermal insulating panels.

All of the metal components utilized in the method of the invention, including the tie bars, pattress plates, brackets, nuts and metal framework, may be rendered corrosion resistant for example by being made from stainless steel or by being galvanized. The galvanization, if applied, may be by zinc plating, hot dip galvanization or sherardization.

Significant advantages of the method of the invention are that the building has not only been clad with securely supported and accurately positioned EWI panels which improve the appearance and the thermal insulation of the building, but also it has been considerably strengthened against potential disproportionate collapse. Not only are the EWI panels supported by tie bars anchored to both the external wall panels and the floor/ceiling panels, but also the external wall panels of the large panel structure are far more securely anchored to the floor/ceiling panels than before the EWI cladding is applied. The anchorage together of the wall panels and the floor/ceiling panels of the large panel construction is no longer simple edge-to-edge anchorage. The tie bars extend some considerable distance into the floor/ceiling panels around the edge of the building, providing an anchorage well into the width of the building which is an excellent countermeasure to prevent or reduce disproportionate collapse.

The insertion of a single tie bar as described above into each tie bar anchorage hole establishes a secure anchorage of the wall panels to the floor/ceiling panels of the building, but does not materially affect the bending resistance of the floor/ceiling panels. Particularly when the floor/ceiling panels are hollow precast panels with internal voids, it may be desirable as part of the method of the invention to strengthen the panels around the peripheral outer wall of the building to protect against disproportionate collapse of the building caused by bending distortion of those hollow panels. This may be achieved by placing alongside but spaced from each tie bar within the internal voids of the hollow floor/ceiling panels one or more reinforcing bars which are then surrounded by the grouting compound in the second stage of the method of the invention when that grouting compound is injected into floor/ceiling panel voids which provide the tie bar anchorage holes. The reinforcing bars may be supported by spacer elements at least some of which are mounted on the tie bars, and the cage of reinforcing bars and spacer elements should be sized to permit its insertion into the internal voids of the hollow floor/ceiling panels through the core holes drilled from the outside of the building. The connections between the reinforcing bars and spacer elements should be secure connections such as screw threads, grub screws or welded joints. The spacer element located at the innermost end of the tie bar is the anchorage referred to in claim 1 herein and is securely attached to the tie bar by threading or similar other secure means. However all of the spacer elements have an anchorage function in addition to supporting and positioning the reinforcing bars, in that they contribute to the secure bonding of the grout to the concrete internal walls which define the voids in the hollow floor/ceiling panels. They act to restrict the grout flow to ensure that the grout consolidates and backs up against those concrete internal walls and by doing so ensures that the internal voids in the floor/ceiling panels are completely filled with grout for the entire length of the tie bars and anchorage bars. The total encapsulation of all of the spacer elements by the high strength grout ensures that the spacer elements cannot move and become a composite part of the tie bar anchorage construction, capable of resisting any reasonable specified load). The reinforcing bars are preferably made from distressed deformed steel reinforcing bar stock, as are the tie bars, to secure a good bond with the grouting compound after it sets. Alternatively, they may be completely threaded, for example using Gripbar® stock as manufactured by Stainless UK Ltd, enabling them to be screw-threaded to all of the spacer elements as well as providing a good bond to the grouting compound.

Preferably a cluster of two, three or four such reinforcing bars is arranged around each tie bar, held by the spacer elements near the top and bottom of the internal voids in the floor/ceiling panels. Of course, the spacer elements must be sized sufficiently small to enable them to be inserted into the tie bar anchorage holes, passing through the core holes drilled from the outside of the building. Furthermore, the spacer elements must include apertures or recesses to allow the flow of grout to each side of each spacer element during the second stage of the method of the invention, so that on completion of the second stage the tie bars, the reinforcing bars and the spacer elements are all completely surrounded by the grout. That ensures that after the setting of the grout the floor/ceiling panels are significantly strengthened against bending deformation for the entire length of the reinforcing bars.

BRIEF DESCRIPTION OF DRAWINGS

Drawings: The invention is illustrated by the drawings of which.

DETAILED DESCRIPTION OF EMBODIMENTS

Embodiments of the present invention will now be described by way of example only and with reference to the accompanying drawings.

Figure 1:
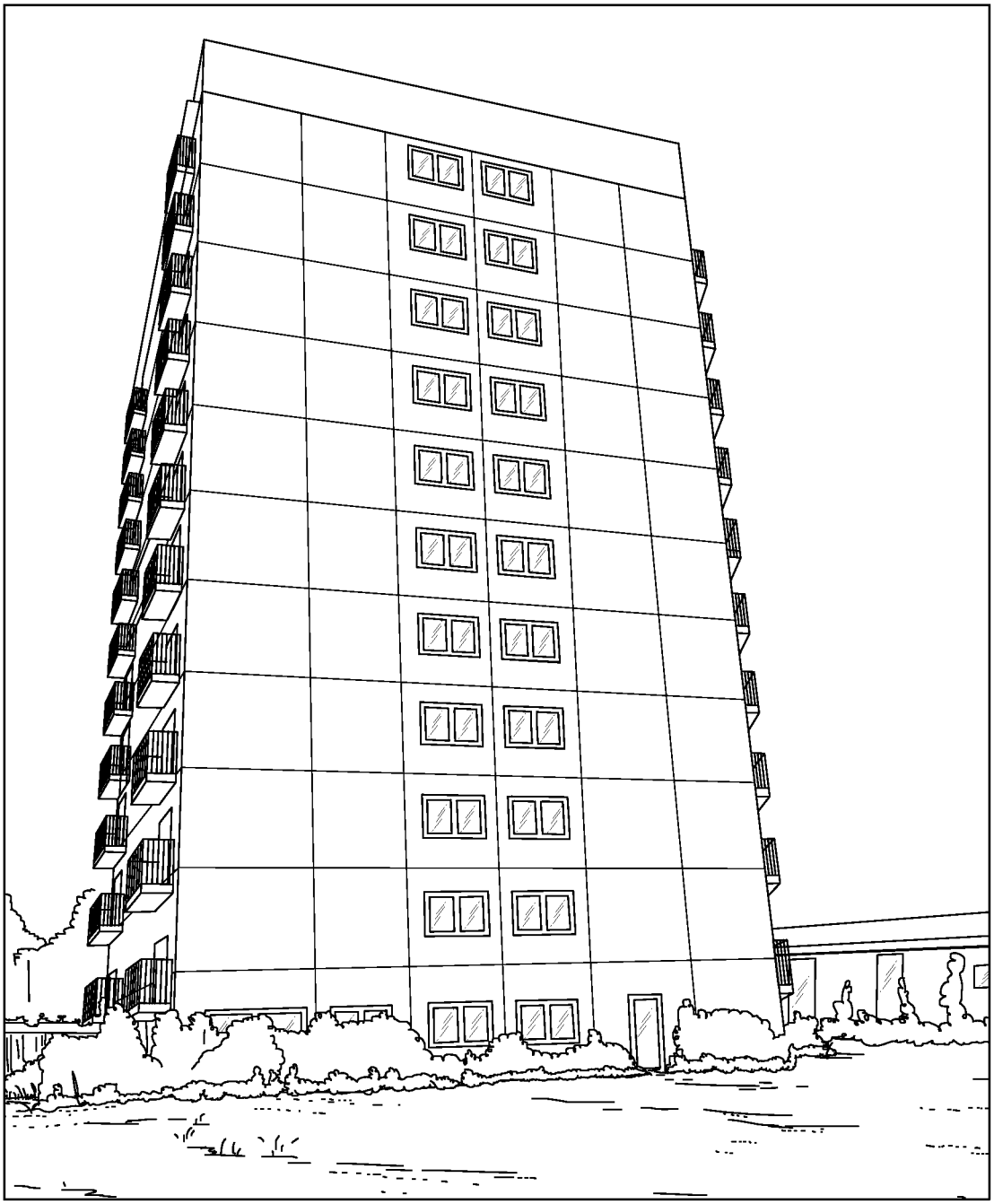
FIG. 1 is a photograph of a tower block building of large panel construction.
Figure 2:
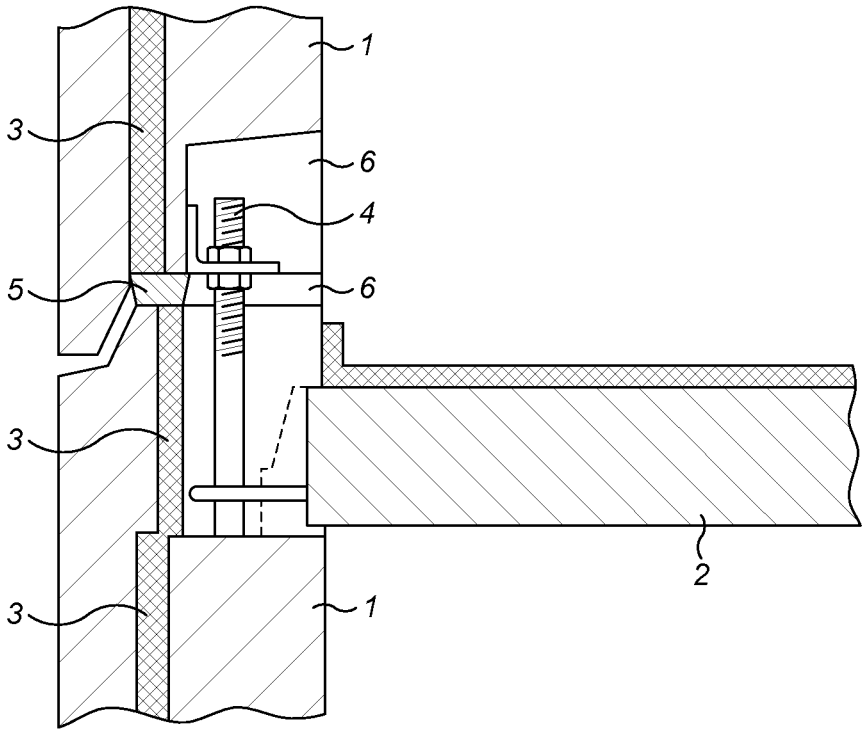
FIG. 2 is a section through one corner of a junction between external wall panels and a floor/ceiling panel of the building of FIG. 1.
Figure 3:
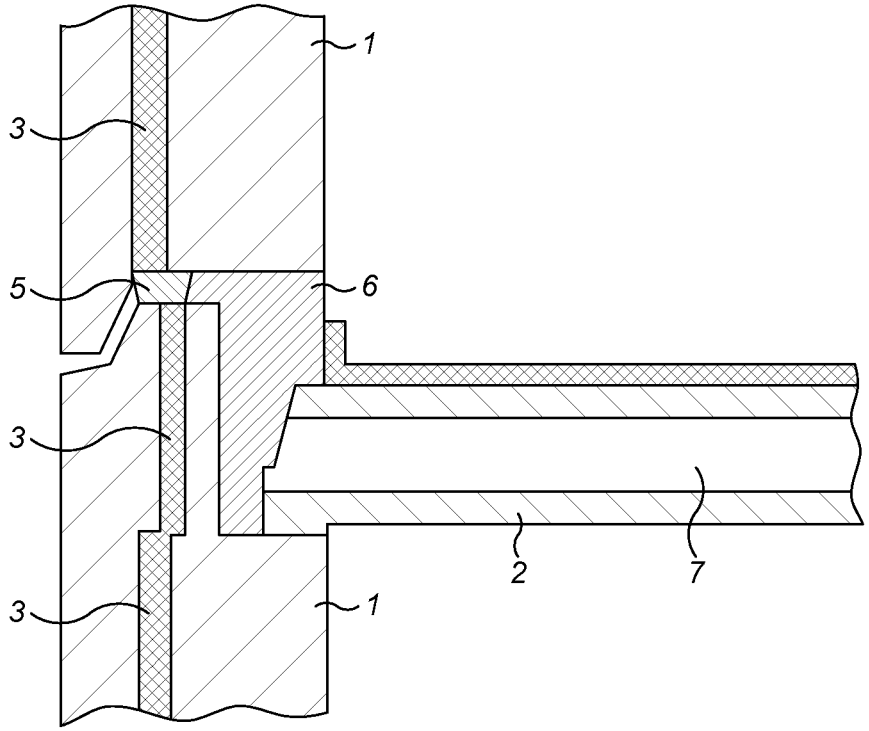
FIG. 3 is a section similar to that of FIG. 2 but in a plane displaced from the former so that the section passes through one of the voids shown in FIG. 2*a;*

Referring first to FIG. 1, there is shown a tower block building to be clad and reinforced against disproportionate collapse according to the method of the invention. The building is of large panel construction, and FIGS. 2 and 3 show how the external wall panels 1 and floor/ceiling panels 2 of the building are bolted edge to edge in the large panel construction method. The wall panels 1 include internal thermal insulation layers shown schematically as 3, which separate each external wall panel 1 into inner and outer leaves. It is the inner leaf which is load-bearing, in that it supports the adjacent floor/ceiling panel 2. The floor/ceiling panels 2 rest on top edges of the external wall panels 1 with an array of bolts 4 connecting the inner leaf of each external wall panel 1 both to the inner leaf of the wall panel 1 immediately above and to the adjacent floor/ceiling panel 2. A draught seal 5 is shown, and the spaces between the panels after erection are filled with dry-pack mortar 6.

Figure 2A:
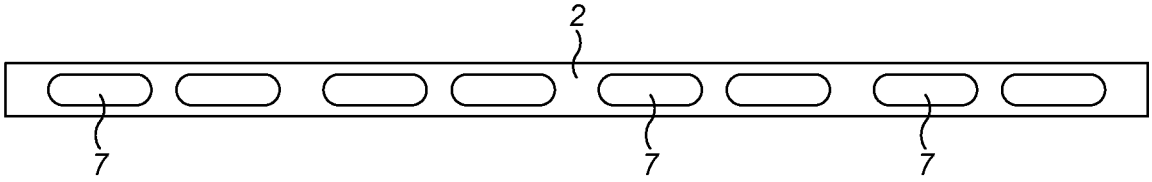
FIG. 2*a* is a section through the floor/ceiling panel, showing internal voids formed in each such panel.

FIG. 2*a* shows the internal construction of the floor/ceiling panels 2 which are Bison (Trade Mark) precast planks. The floor/ceiling panels 2 are formed from reinforced concrete, and to reduce the total weight of each panel the panels in this illustrative example of the invention are formed with pre-cast voids 7 at intervals along the length of each panel. One such void 7 is shown in the section illustrated in FIG. 3, which shows an external wall panel 1 lying perpendicular to the longitudinal axes of the voids 7. Around the corner of the building the external wall panels 1 would lie parallel to the longitudinal axes of the voids 7, so that a similar section to that of FIG. 3 but taken around the corner of the building would show the succession of voids in the floor/ceiling panel 2, as illustrated in FIG. 2*a*.

Figure 4:
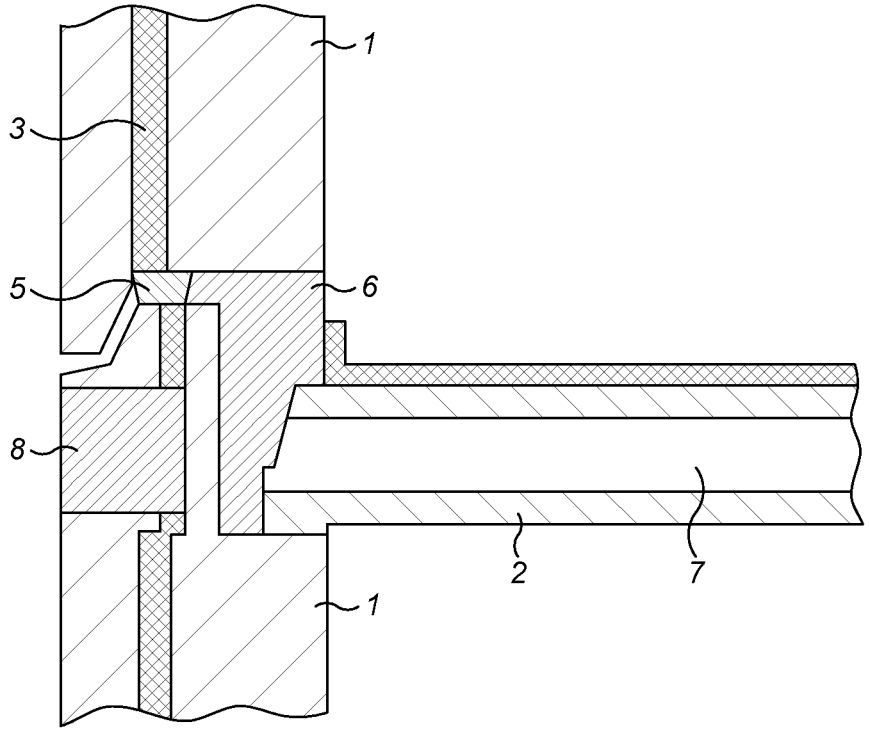
FIG. 4 shows the section of FIG. 3 with the pattress core hole drilled partially through the external wall panel and shown shaded.

FIG. 4 illustrates the first core hole drilling step in this illustrated embodiment of the invention, which involves the drilling of a pattress core hole 8 through the outer leaf of the external wall panel 1, directed axially towards one of the voids 7 in the floor/ceiling panel 2. The location of that void 7 cannot be seen from the exterior of the building before drilling commences, but can be established from the specification of the floor/ceiling panels 2, or from X-ray inspection of the building. If desired, a series of preliminary exploratory pilot holes can be drilled through the exterior wall panel 1 and into the floor/ceiling panel 2 and voids 7 before drilling the core hole 8, to establish the precise pattern and location of the floor/ceiling panels 2 and their voids 7. Alternatively if the approximate location of the voids 7 is first established for example by reference to initial plans of the building and/or by X-ray scanning, the pattress core holes 8 may be drilled part-way through the external wall panels 1 towards those approximate void locations, and the precise pattern, size and location of the voids may be established by drilling one or more pilot holes through the remaining thickness of the external wall panels 1 from the base of one or more of the pattress core holes 8. The pattress core hole 8 is shown cross-hatched in FIG. 4 purely to enable the reader easily to identify the location and extent of that hole. The pattress core hole 8 will eventually receive and locate a pattress plate, but that plate is not placed in position until later in the method of the invention.

Figure 5:
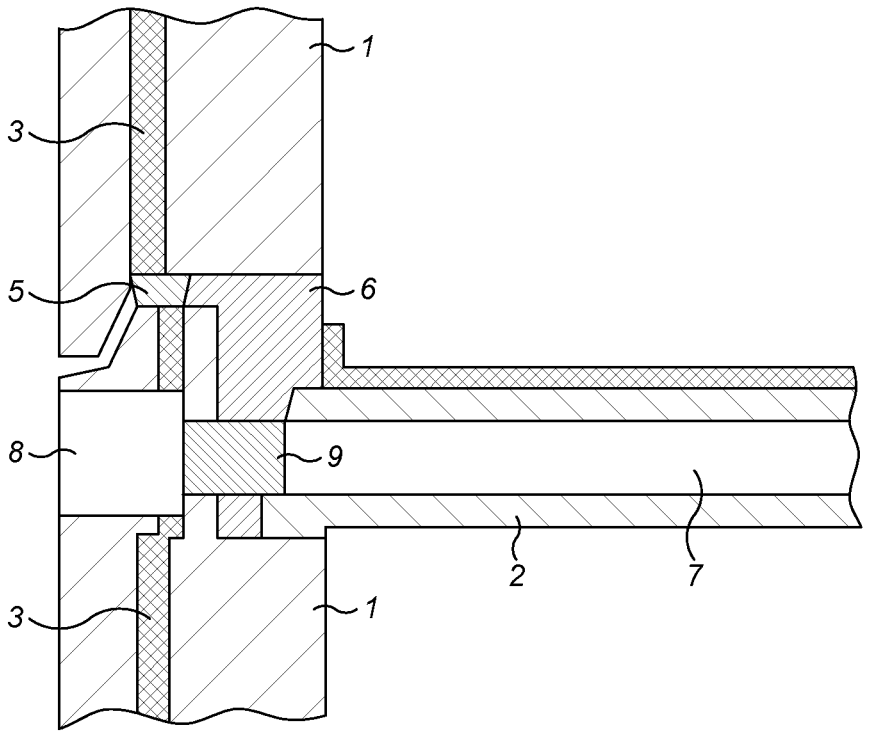
FIG. 5 is the section of FIG. 4 but with a further core hole drilled and shown shaded, joining the pattress core hole to an internal void in the floor/ceiling panel.

The next step in the method of the invention is illustrated in FIG. 5, and involves the removal of a second core of concrete from the base of the pattress core hole 8 so as to connect to the adjacent void 7. That second core of concrete is shown cross-hatched in FIG. 5 and numbered 9. Of course, if the pattress core hole had been bored completely through the wall panel 1 rather than partially therethrough, it would not have been necessary to remove the second core 9. If the wall panel 1 had been on an adjacent external wall of the building, so that it lay other than perpendicularly to the line of the voids 7 in the floor/ceiling panels 7, then the second core hole would have had to extend into the floor/ceiling panel 2 through each in turn of the concrete walls separating adjacent voids 7, for the full length of the tie bars which are to be received in and anchored to the floor/ceiling panels 2 in the subsequent steps of the method of the invention. The second core holes and voids 7 together form tie bar anchorage holes for those tie bars. If the floor/ceiling panels 2 had been solid panels without voids 7, the second core would have had to be drilled through the inner leaf of the wall panel 1 and into the solid concrete of the floor/ceiling panel 2 for the full depth of the resulting tie bar anchorage hole. For all such drilling of core holes laser-guided drilling rigs are preferably used, with diamond edged core drills.

Figure 6:
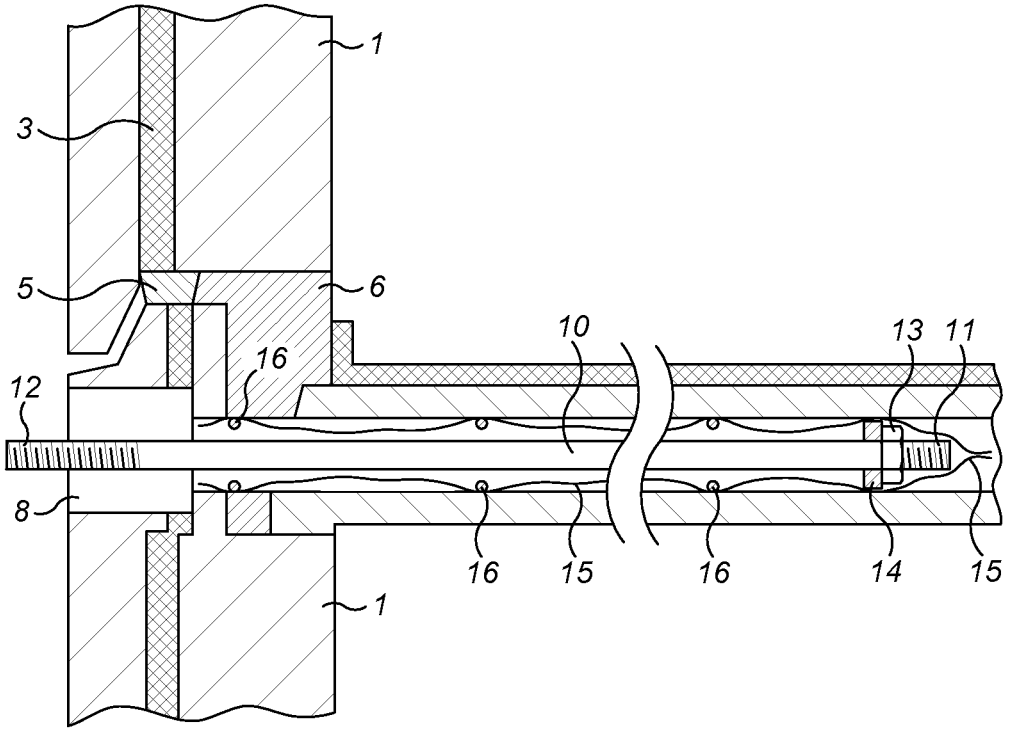
FIG. 6 is the section of FIG. 5 showing the insertion of a tie bar and sleeve through the pattress core hole and into the void.

FIG. 6 shows the next step in the method which commences with the insertion, into each tie bar anchorage hole, of a tie bar 10. The tie bar 10 may be made from standard deformed steel reinforcing bar stock, with external screw threads rolled into its ends 11 and 12. The screw-threaded end 11 carries an anchorage for anchoring the tie bar 10 in its tie bar anchorage hole, comprising a nut 13 which clamps a washer 14 against a shoulder of the tie bar 10. The screw-threaded end 12 extends from the pattress core hole 8. Before the tie bar 10 is passed down the core holes 8 and 9 and into the void 7 an optional fabric sleeve 15 may be placed around the end 11 and washer 14 and around a number of wire spacers 16 spaced along the tie bar 10 to hold the sleeve 15 away from the tie bar 10. The sleeve 15 need not extend the complete length of the tie bar 10. It is sufficient that it is around the anchorage end 11. The wire spacers 16 also serve to hold the tie bar 10 generally centrally in the void 7, resisting excessive sagging of the tie bar 10.

Figure 7:
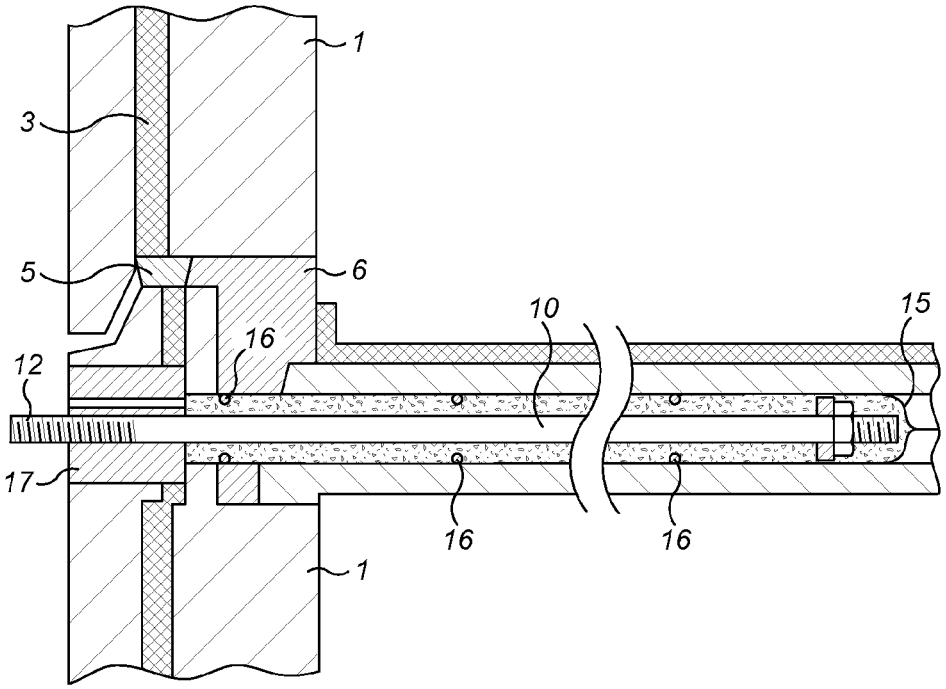
FIG. 7 is the section of FIG. 6 after insertion of a pattress plate into the pattress core hole, with the tie bar extending through a central aperture in the pattress plate, and after extrusion of a grouting compound into the sleeve surrounding the tie bar.
Figure 8:
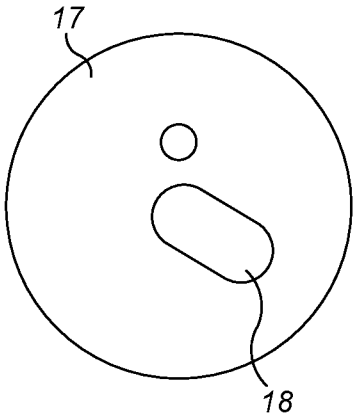
FIG. 8 is a front view of the pattress plate of FIG. 7.
Figure 8A:
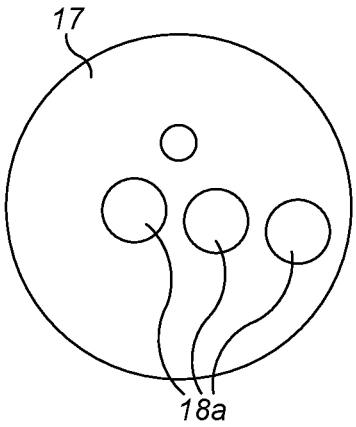
FIG. 8*a* is a front view of an alternative design of pattress plate.
Figure 8B:
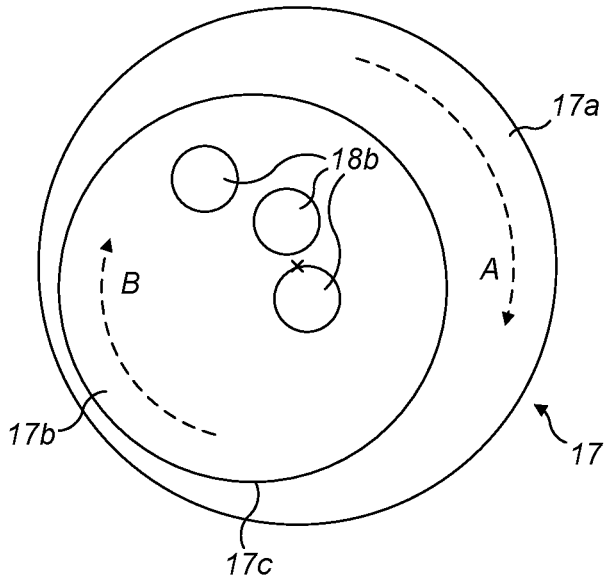
FIGS. 8*b* and 8*c* are front views of another alternative design of pattress plate, being a two-part pattress plate shown with the parts in two different angular conditions to show how the tie bar receiving hole can be adjusted to a range of off-centre locations.
Figure 8C:
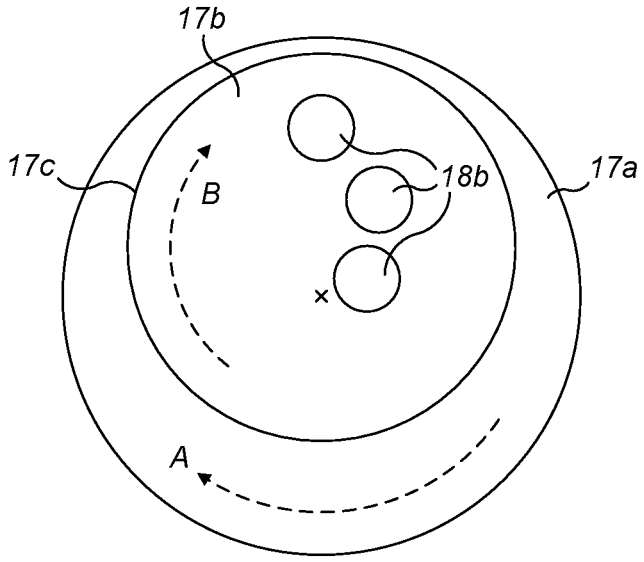
Figure 9:
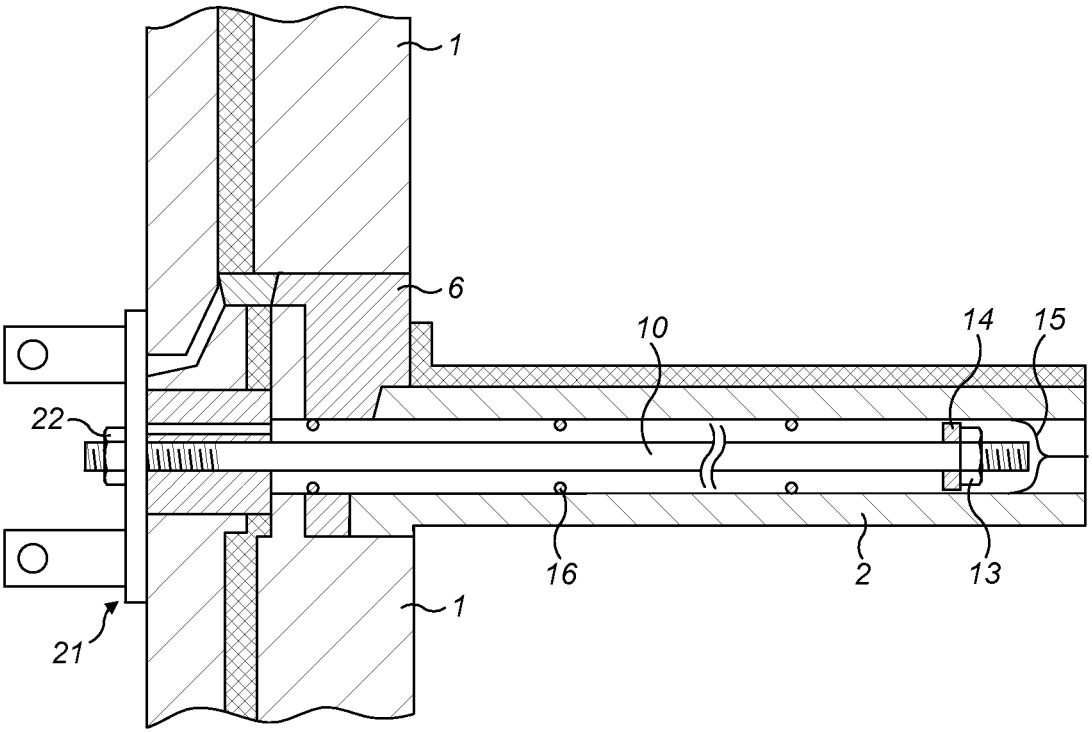
FIG. 9 is the section of FIG. 7 after the grouting compound has set and after an anchorage bracket for the external framework has been bolted to the tie bar.

A circular pattress plate 17 is then placed around the end 12 of the tie bar 10 and into the pattress core hole 8, as illustrated in FIG. 7. The pattress plate 17 has an aperture through which the tie bar 10 passes. For example, that aperture may be a central axial bore (not separately illustrated) or it may be a radial extending slot 18, as shown in FIG. 8, through which the tie bar 10 passes. The radial extent of the slot ensures that even if the end 12 of the tie bar 10 is eccentric in its pattress core hole (for example because the weight of the tie bar 10 has caused it to sag or bend) it can be threaded through the slot in the pattress plate 17. Once the pattress plate 17 is in its core hole 8 as shown in FIG. 7 it can if desired be rotated to move the tie rod to the axial centre of the pattress core hole 8. Alternatively the pattress plate may have a number of discrete apertures 18*a* at different distances from its axial centre, as shown in FIG. 8*a*, and the tie bar 10 may then be passed through whichever of those is conveniently aligned with the end of the tie bar 10. A further alternative is illustrated in FIGS. 8*b* and 8*c*. Such a pattress plate 17 is formed as two parts, numbered 17*a* and 17*b*. Part 17*a* is a circular plate the diameter of the pattress core hole 17 but has an eccentric circular recess 17*c* formed therein. The axis of the part 17*a* is shown as X. The part 17*b* is a circular plate the same diameter as the recess 17*c* and can rotate in the recess 17*c*. Eccentric apertures 18*b* are formed in the part 17*b*. Rotation of the part 17*a* in its pattress core hole 17 in the direction of arrow A causes the central axis of the part 17*b* to precess around the central axis of the pattress core hole 17, and rotation of the part 17*b* in the recess 17*c* in the direction of arrow B causes the apertures 18*b* to precess around the central axis of the recess 17*c*. Suitable rotation of the two parts 17*a* and 17*b* therefore causes an orbital movement of the apertures 18*b* and by such movement it is possible to align one of the apertures 18*b* with the end 12 of the tie bar 10 even if the end 12 is eccentric in the pattress core hole 17. FIGS. 8*b* and 8*c* show different rotational conditions of parts 17*a* and 17*b* after rotation in the direction of the respective arrows A and B.

There is another hole formed in the pattress plate 17 of FIGS. 7, 8 and 8*a*. That is an eccentric grout injection hole. Any one of the three apertures 18*b* of FIGS. 8*b* and 8*c* that is not used to receive the tie bar 10 can be used as that grout injection hole of FIGS. 8*b* and 8*c*. While the pattress plate 17 is held firmly in position by a holding nut (not shown in FIG. 7) threaded onto the threaded projecting end 12 of the tie bar 10, a grouting compound is extruded down a flexible grout injection tube (not shown in the Figures) which extends through the grout injection hole and down through the sleeve 15 to the end 11 of the tie bar 10. Filling the void 7 with grout therefore proceeds from the innermost end 11 of the tie bar 10, back towards the pattress plate 17. The flexible grout injection tube is withdrawn during grout injection. The sleeve 15 stops the grouting compound from flowing beyond the anchor 13, guides the grouting compound along the void 7 and expands under the pressure of the grouting compound so that the sleeve becomes pressed against the internal walls of the void. The grouting compound permeates through the sleeve material and adheres to the internal walls of the void, but the sleeve 15 prevents the grout from flowing freely into any internal spaces along the length of the tie bar 10 and at the end 11 of the tie bar 10.

Figure 7A:
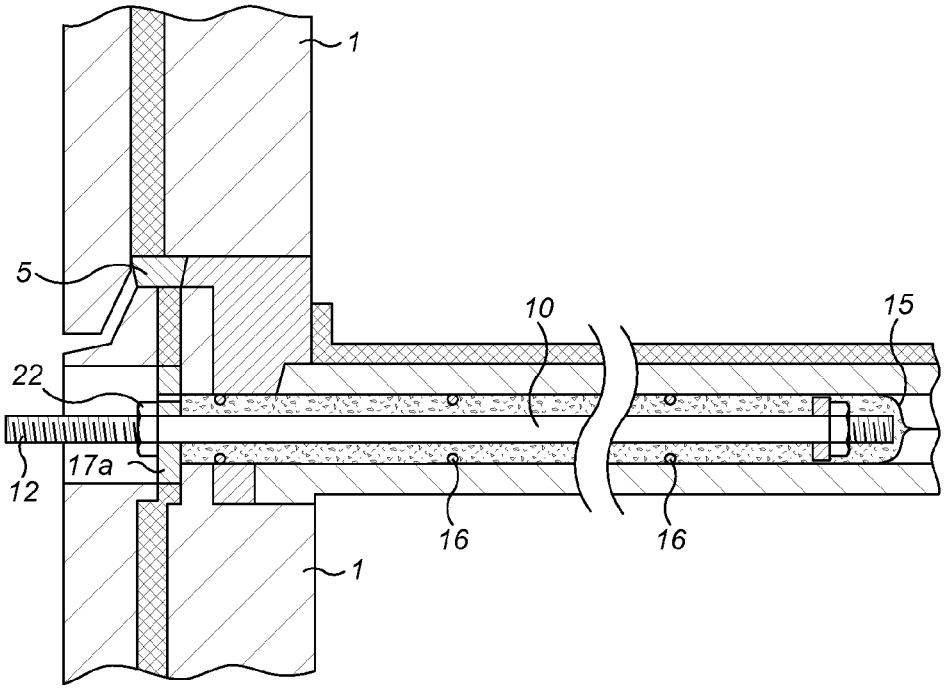
FIGS. 7*a* and 7*b* are sections similar to that of FIG. 7 but demonstrating the option of a two part pattress plate of which an inner element is shown in place in FIG. 7*a* and both inner and outer elements are in place in FIG. 7*b*, separated by a spacer and shim washer.
Figure 7B:
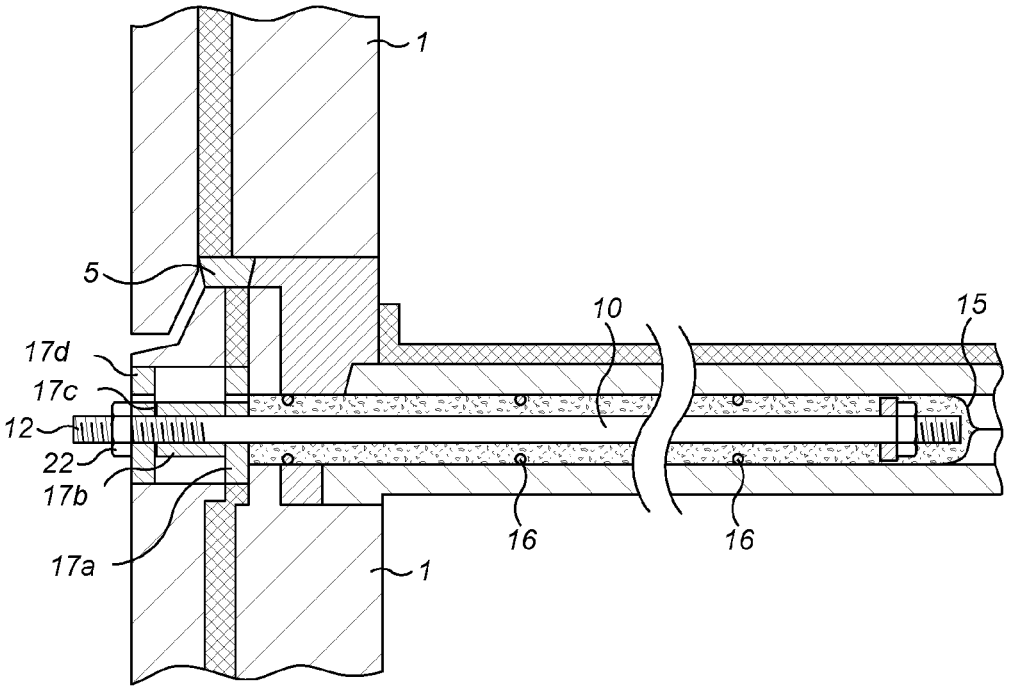

The pattress core hole into which the pattress plates of FIG. 7 or 8 to 8*c* are received is drilled for a precise controlled depth into the wall panel 1, that depth being designed to bring the outer face of the inserted pattress plate into coplanar vertical alignment with the outer face of the wall panel 1 or into an alignment that is recessed for a precise predetermined amount into the wall panel 1, that amount being as specified by a structural engineer and being dependent on the design of the bracket or other mounting elements used to support the metal framework for the EWI panels. An alternative to the very precise depth drilling of the pattress core hole is illustrated in FIGS. 7*a* and 7*b* and utilizes a composite pattress plate that can be utilize any of the alternative pattress plate shapes of FIGS. 7 and 8 to 8*d*. Such a composite pattress plate comprises two pattress plate elements 17*a* and 17*d*. The injection of grout is as described above but is carried out in two stages. In the first stage, illustrated in FIG. 7*a*, only the inner pattress plate element 17*a* is inserted into the pattress core hole and held in position against the inner leaf of the wall panel by a holding nut 22. The grout is injected down its injection tube until the associated tie bar anchorage hole is filled. When the grout has set sufficiently, the holding nut 22 may be unscrewed and if desired the pattress plate element 17*a* removed to carry out a visual inspection to confirm that the tie bar anchorage hole has been completely filled. Then as shown in FIG. 7*b* the pattress plate inner element 17*a* once again placed in position, and if desired held in place by replacement of the holding nut 22 (optional, so not shown in FIG. 7*b*) tightened to a predetermined torque. A tubular cylindrical metal spacer 17*b*, a shim washer 17*c* and the pattress plate outer element 17*d* are then placed around the protruding end 12 of the tie bar 10, and the alignment between the outer end of the pattress plate element 17*d* and the plane of the wall panel 1 is carefully checked. The shim washer 17*c* can be exchanged for another of different thickness or supplemented with additional shim washers of suitable thickness until the pattress plate element 17*d* extends to a precise plane flush with or a predefined distance behind the wall panel outer face. The holding nut 22 (or a second holding nut 22 if the pattress plate inner element 17*a* has been held in place by its own holding nut as indicated above as a possible option) is then threaded onto the end 12 of the tie rod 10, to hold the entire pattress plate assembly 17*a* to 17*d* in place. Finally the void around the spacer 17*b* is filled with grout by injecting the grout through an eccentric grout hole (illustrated but unreferenced) in the pattress plate outer element 17*d*.

Figure 7C:
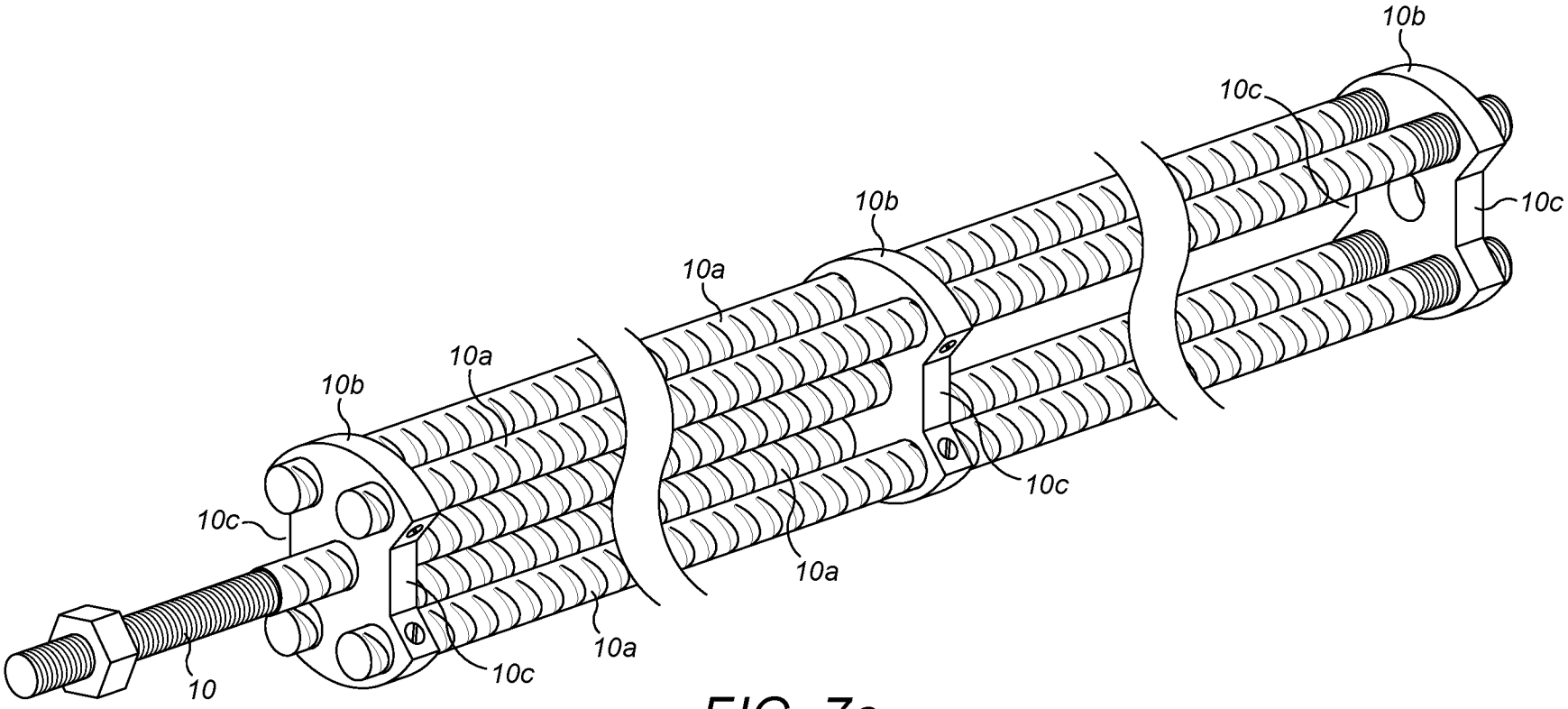
FIG. 7*c* is a perspective view of a tie bar which has attached thereto a cluster of four reinforcing bars, to achieve additional strengthening of the floor/ceiling panels into which it is inserted according to the invention.

FIG. 7*c* illustrates how the tie bar 10 can support one or more reinforcing bars 10*a* of standard deformed steel. A cluster of four such reinforcing bars is shown in FIG. 7*c*, but fewer or more such bars may be used, each spaced from the tie bar 10 and held in position by spacer elements 10*b*. The spacer elements 10*b* hold the four reinforcing bars 10*a* illustrated in FIG. 7*c* near the top and bottom of the voids 7 in the floor/ceiling panels 2 so as to achieve maximum reinforcement. The spacer elements 10*b* along the length of the reinforcing bars 10*a* may be made from plastics material, for example nylon, or from metal, for example steel, since their primary function is to hold the reinforcing bars in position until they are encased in the grouting compound 20 injected down voids 7 which provide the tie bar anchorage holes. Their presence avoids the need for the wire spacers 16 discussed previously because the spacer elements 10*b* also hold the tie bars 10 centrally in the voids 7, and hold the sleeve 15 (if present) away from the cage of tie bars and reinforcing bars. The spacer element 10*b* at the innermost end of the tie bar 10, however, doubles as the anchor 14 of FIG. 6, and should preferably be of steel and is securely fastened to the tie bar 10 by a nut similar to the nut 13 of FIG. 6 or by being screw-threaded directly onto the threaded end of the tie bar 10. Similarly the spacer elements 10*b* at the ends of the reinforcing bars 10*a* are preferably of steel and are securely connected to the reinforcing bars by nuts or by direct screw threads. The other spacer elements 10*c* spaced at intervals along the length of the reinforcing bars 10*b* are preferably connected to the reinforcing bars 10*a* by grub screws.

Once the injected grouting compound has set, the reinforcement provided by the bars 10*a* adds very significantly to the strength of the floor/ceiling panels, providing additional strength to resist bending deformation of those floor/ceiling panels along the length of the reinforcing bars 10*a*. Furthermore, the security of the anchorage of the tie bars in the tie bar anchorage holes is significantly increased by the presence of the spacer elements 10*b*. The structural integrity of the building is thus much enhanced by the inclusion of the reinforcing bars 10*a*. In FIG. 7*c* the reinforcing bars 10*a* are shown as being longer than the tie bar 10 so that they extend into the voids 7 beyond the ends of the tie bars 10, but they may if desired extend into the voids 7 for the same distance as the tie bars 10 or for a lesser distance. Of course, when the grouting compound is injected into the voids 7 it should be injected as far as the innermost end of both the tie bars 10 and the reinforcing bars 10*a*. If a sleeve 15 is used to surround the tie bar/reinforcing bar assembly, it should extend around the innermost spacer element 10*b* and the innermost end of the tie bars 10 and the reinforcing bars 10*a*.

The injection of the grouting compound around the reinforcing bars 10*a* is slightly more complicated than the grout injection when no such reinforcing bars are used. A similar rigid or flexible grout injection tube may be used, so that the grouting compound fills the void 7 around the reinforcing bars 10*a* and tie bar 10 starting at the innermost end of the tie bar/reinforcing bar assembly. That injection tube (not illustrated) passes initially past the spacer elements 10*b* which have peripheral cut-away portions 10*c* to allow for the insertion of the grout injection tube to the innermost end of the tie bar/reinforcing bar assembly. The injection tube is withdrawn as the grouting compound is injected, but care needs to be taken to ensure that no unfilled spaces are left in the voids 7 during the grout injection. One method of achieving that is for the injection tube to be marked with the distances spacing apart the spacer elements 10*b* along the length of the reinforcing bars 10*a*. As the injection of grout proceeds and the injection tube is withdrawn, that withdrawal can be paused as each such marking is revealed, and the grout injection continued for a period without moving the injection tube, so as to be certain that the void 7 is completely filled back to each in turn of the spacer elements 10*b*. The grout injection pressure assists the withdrawal of the injection tube. The grout injection pressure can be monitored as a guide to indicate when each section of the void 7 is completely filled. When the grouting compound has set, the spaced apart reinforcing bars 10*a* create a highly beneficial strengthening of the floor/ceiling panels 2 both to enhance the anchorage of the tie bars 10 in the tie bar anchorage holes and to resist bending stresses around the periphery of the building. To ensure that the grout achieves a high strength bond with both the reinforcing bars 10*a* and the internal surface of the voids 7 the tie bar anchorage holes may be pre-wet before the grout is injected to prevent moisture in the grout being absorbed by the concrete. This allows the grout to cure completely, with a good bond to both the concrete floor/ceiling panels 2 and the reinforcing bars 10*a*.

Whichever of the above alternative pattress plates is used, and whether or not the reinforcing bars 10*a* of FIG. 7*c* are included, when the grouting compound 20 has set, each tie bar 10 is securely anchored in the floor/ceiling panel 2 by a cementitious or resinous grout bond which extends continuously from the pattress plate 17 to the anchorage 14 of FIG. 7 or to the innermost end of the tie bar/reinforcing bar assembly of FIG. 7*c*, with the externally threaded end portion 12 of each tie bar 10 projecting from its pattress plate 17. The security of that anchorage is preferably tested before the metal framework is attached to the tie bars 10, and the results of that testing for each in turn of the tie bars 10 is preferably retained for the lifetime of the building as an accurate record of the competence of the reinforcement. Then anchorage brackets can be attached to the projecting externally threaded ends 12 of the tie bars 10 and held in place by nuts 22. The anchorage brackets may be any suitable size and shape to secure in position a metal framework for supporting external wall insulation (EWI) panels for the building.

Figure 10:
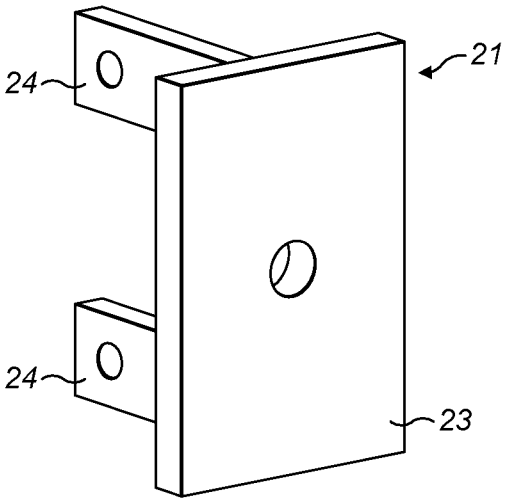
FIG. 10 is a perspective view of the anchorage bracket of FIG. 9.
Figure 10A:
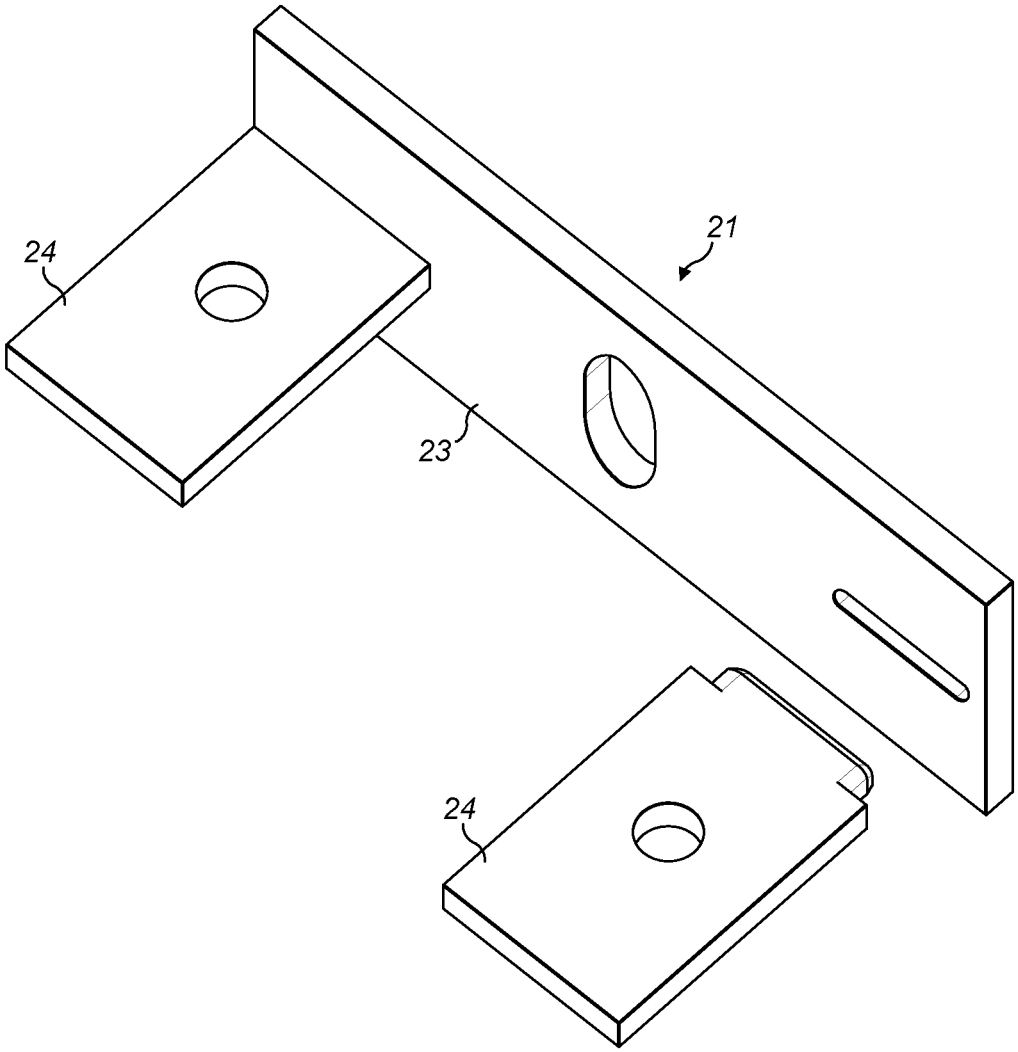
FIG. 10*a* is an exploded perspective view of the anchorage bracket of FIG. 10 before all of its components are welded together.
Figure 11:
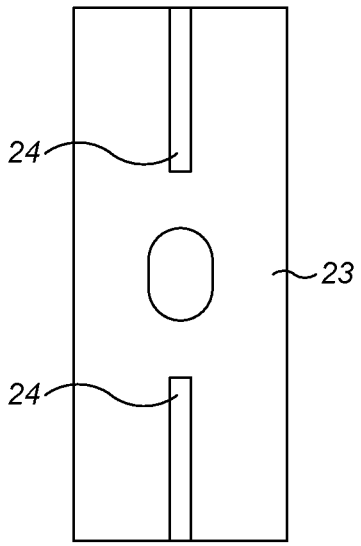
FIGS. 11, 12 and 13 are front, side and top views of the anchorage bracket of FIG. 10.
Figure 12:
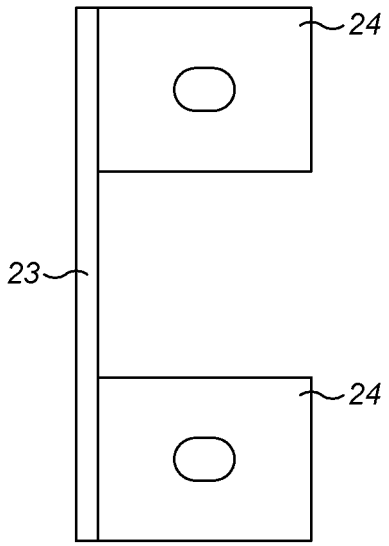
Figure 13:
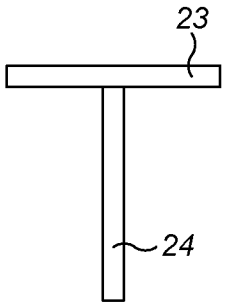
Figure 14:
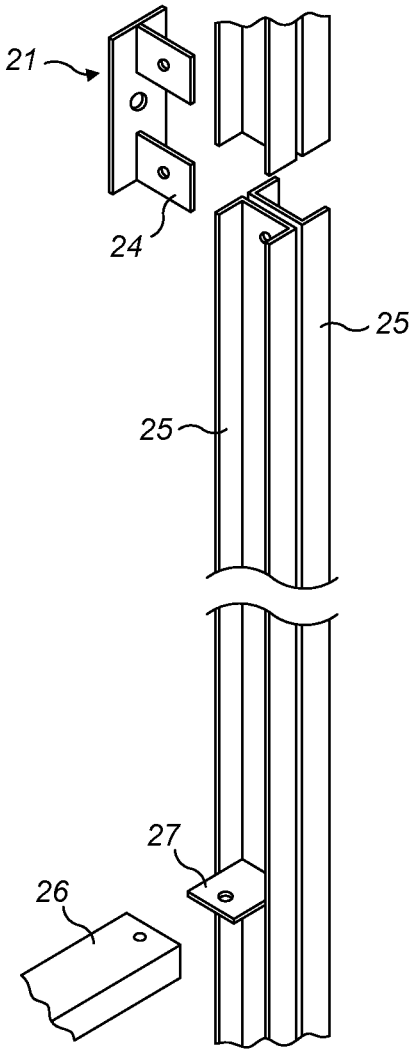
FIG. 14 is a schematic illustration of the connection of the support framework to the anchorage brackets.
Figure 14A:
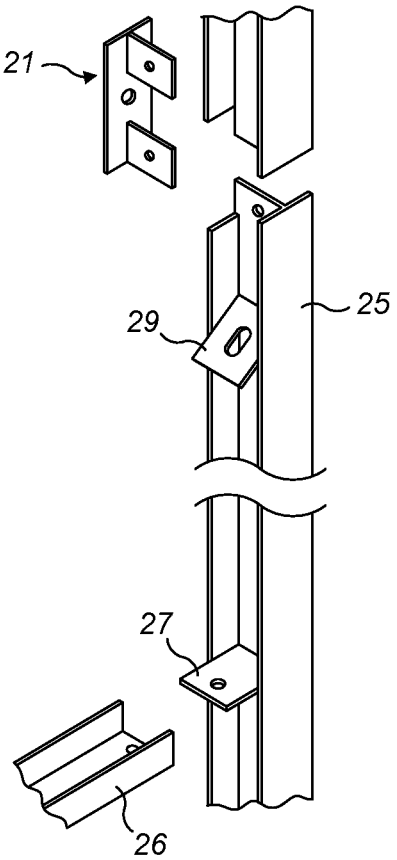
FIG. 14*a* is a modification of FIG. 14 showing an additional support flange or projection for supporting an optional diagonal brace member of the support framework.
Figure 15:
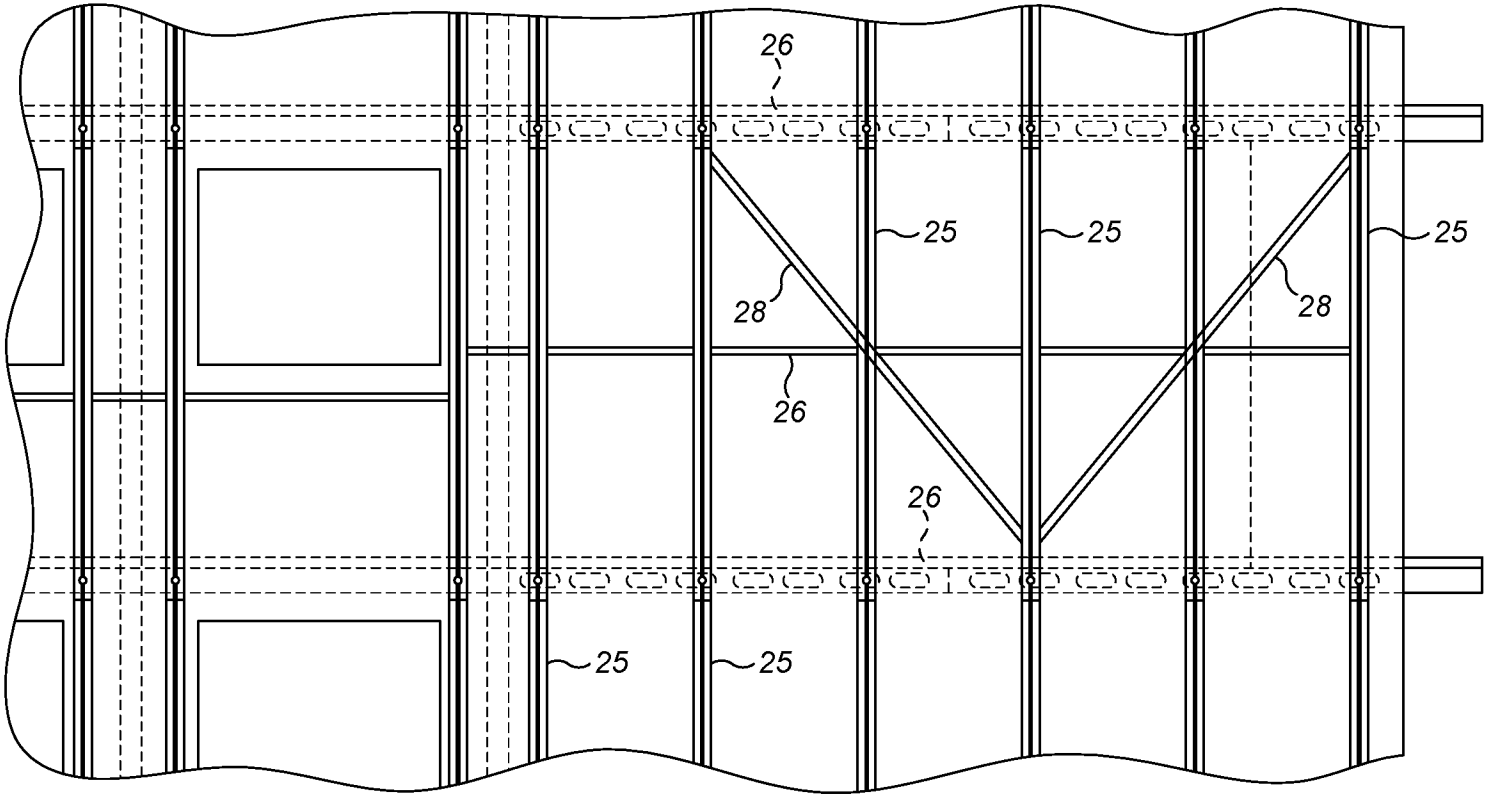
FIG. 15 is a front view of a part of the support framework, including optional diagonal brace members, in position on the face of the building.

One such anchorage bracket, to suit the metal framework of FIGS. 14 and 15, is illustrated as bracket 21 in FIGS. 10 to 13. The bracket 21 comprises a plate portion 23 and a pair of flange portions 24. FIG. 10*a* illustrates one possible method of construction of the anchorage bracket 21, with each flange portion 24 being provided with a tenon portion which is received in a mortise slot in the plate portion 23 before being welded in place. Instead of the tenon portions illustrated in FIG. 10*a*, discrete stud portions of the flange portions 24 may be welded into spaced apart bores in the plate portions 23. Each anchorage bracket 21 is of a size and shape to support a vertical rail of a support framework. In FIG. 14, that vertical rail comprises a pair of cold rolled steel sections 25 clamped back to back against opposite vertical sides of the flange portions 24 of the bracket 21. The vertical rails are fastened to the brackets 21 by bolts (not shown) passing through holes (circular or elongate) in the flange portions 24. Each vertical rail 25 is of generally U-shaped section and comprises a central web and inner and outer flange portions of which an inner flange portion lies against the vertical outer wall of the building and an outer flange portion is spaced from the outer wall of the building. Although not shown in FIG. 14, the inner flange portion of each steel section 25 would be cut away slightly as shown in FIG. 14*a* to accommodate the thickness of the plate portions 23 of the brackets 21. An alternative method, not illustrated, of mounting similarly shaped vertical rails 25 on the threaded end portions of the tie bars uses an alternative design of bracket 21. Such a bracket 21 is a metal plate secured to the tie bar by the holding nut 22. The metal plate bracket 21 would be of a sufficient thickness that set screws passing through holes formed in the inner flange portion of the vertical rail 25 can be securely retained in threaded holes formed in the face of the metal plate bracket which is held against the outer wall of the building by the holding nut 22. To assemble and secure in place those vertical rails, each vertical rail is positioned with its upper end over the metal plate bracket and secured to the metal plate bracket using the above set screws. A connecting plate is then bolted to the outer flange portion of the vertical rail, to overlie the outer flange portion of the next higher vertical rail. When the vertical rails are accurately positioned, with their positioning and alignment preferably checked by lasers, adjacent pairs of vertical rails can be secured to one another by bolts passing through holes drilled on-site through the overlying connecting plates and outer flange portions of the vertical rails.

If desired, each vertical rail or selected vertical rails may be supported at locations between adjacent anchorage brackets by additional support brackets connected to the external wall panels of the building. Such intermediate support (not illustrated in the drawings) adds to the rigidity and security of the vertical rail assembly. If the external wall panels are composite wall panels with inner and outer leaves, then the additional support brackets may be connected to the outer leaves only, or may be recessed into the outer leaves and also connected through to the inner leaves of such composite wall panels to connect both the inner and outer leaves of the outer wall of the building to the metal framework at positions between adjacent anchorage brackets.

Figure 14B:
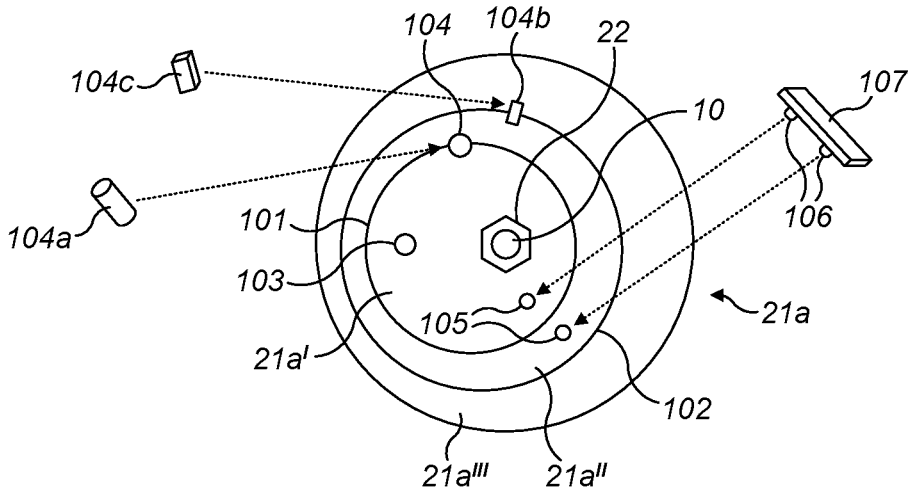
FIG. 14*b* is a plan view of a mounting plate assembly for use as a bracket to attach the vertical rails of a metal framework to the tie bar of any of FIGS. 2 to 9.
Figure 14C:
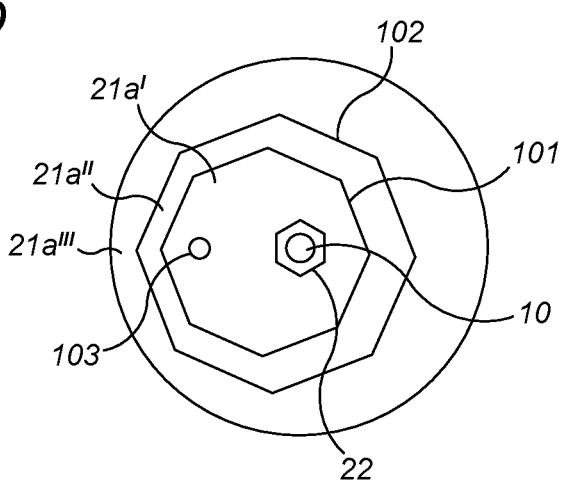
FIGS. 14*c* and 14*d* are plan views of two alternative mounting plate assemblies similar to that of FIG. 14*b*.
Figure 14D:
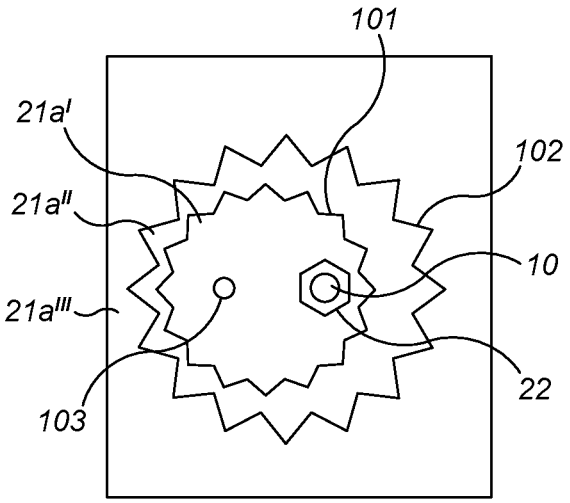

If desired, the mounting brackets 21 which secure in place the vertical rails 25 of the metal framework may incorporate means for precise and controlled vertical and horizontal adjustment of the vertical rails before the final positioning and alignment of those vertical rails is checked as described above. The tie bars 10 have been set in position before the vertical rails are attached, but those tie bars 10 may not have the precise degree of accurate vertical and horizontal alignment required of the metal framework. Therefore, the mounting brackets may be mounting plate assemblies, incorporating some degree of adjustability between central portions which are secured in place by the tie bars and outer portions which support the vertical rails 25. For example the outer portions may be rotatable relative to the inner portions about an eccentric axis, so that with the inner portions in fixed positions clamped to or integral with the pattress plates 17 and tie bars 10, the outer portions can be rotated about that axis eccentric to the tie bar 10 axis until the desired horizontal and vertical alignment is achieved. If desired the angular rotation may be a free rotation to any angle, as illustrated in FIG. 14*b*, or it may be to a series of predefined angular increments, as illustrated in FIGS. 14*c* and 14*d*. In FIG. 14*b* the mounting bracket is numbered 21*a* and is in three parts. A central part 21*a* is locked fast to the tie bar 10 by the holding nut 22. The central part 21*a*' incorporates an eccentric stepped circular recess 101 receiving a ring part 21*a*" and the ring part 21*a*" itself incorporates an eccentric stepped circular recess 102 which receives an outer ring part 21*a*". The recesses 101 and 102 are stepped so that they permit rotation of the ring parts 21*a*" and 21*a*" while preventing them from moving outwardly away from the pattress plate 17 and from outer wall 1 of the building. Rotation of the ring parts 21*a*" and 21*a*" in their circular recesses 101 and 102 causes a combination of horizontal and vertical movement of a threaded anchor hole 103 which receives the set screw described above for anchoring the vertical rail 25 to the bracket 21*a*. Once the desired vertical and horizontal adjustment is obtained, the ring parts 21*a*" and 21*a*" can be locked against further rotation either by drilling dowel holes 104 or milling other anchorage holes or slots 104*b* spanning the boundaries of adjacent ring parts 21*a*', 21*a*" and 21*a*'" and inserting dowels 104*a* or anchorage plates 104*c* into those dowel or anchorage holes or slots, or by drilling pairs of anchor holes 105 into adjacent ring parts 21*a*', 21*a*" and 21*a*', and inserting dowel protrusions 106 of locking elements 107 into those drilled anchor holes 105. The recesses 101 and 102 are described and illustrated in FIG. 14*b* as being circular, but as an alternative they may be shaped as regular polygons as illustrated in FIG. 14*c* or toothed like gear wheels as illustrated in FIG. 14*d*, so that incremental angular movement of the ring parts 21*a*" and 21*a*'" is all that is permitted in order to obtain the desired horizontal and vertical alignment of the mounting bracket 21*a*, in which case the dowel holes or slots 104 or 104*b* or the anchor holes 105 are unnecessary because tightening of the holding nut 22 to draw the bracket 21*a* firmly against the pattress plate 17 is sufficient to lock the ring parts 21*a*" and 21*a*'" against further rotation. The outer shape of the outer ring part 21*a*'" is shown as rectangular in FIG. 14*d* merely to illustrate that any outer shape may be suitable.

Horizontal rails 26 of cold rolled steel section are bolted to support flanges or projections 27 carried by the vertical rails, and if desired additional diagonal brace members 28 may be bolted to the vertical or horizontal rails to complete the frame assembly. FIG. 14*a* shows a support flange or projection 29 fitted to the vertical rail 25 to provide an anchorage for the top of one such diagonal brace member 28. FIG. 14*a* also illustrates a one-piece universal vertical rail 25 as an alternative to the two back-to-back rails 25 of FIG. 14. The bolts are fully tightened only after the entire framework has been checked for accurate positioning in the vertical and horizontal planes, there being sufficient flexibility in the framework flanged joints to permit some adjustment before that final tightening. The final nuts to be tightened are the nuts 22 which may be self-locking nuts or may be held against loosening in use for example by additional lock nuts (not shown).

FIG. 15 shows the final support framework against the external wall of the building. It should be understood, however, that the actual size and construction of the support framework is chosen to match and support the actual EWI panels to be hung on the outside of the building. For example, instead of the vertical and horizontal rails of FIGS. 14 and 15 which are parallel flange channels (PFCs) of cold rolled steel section, vertical or horizontal rails of rectangular hollow section or of some different sectional profile may be more suited to the final choice of EWI panels to be used; and the shape of the anchorage bracket 21 of FIGS. 14 and 15 may be different from that illustrated, to match the size and profile of those vertical and horizontal rails. In all cases, however, the anchorage of the support framework to the building will be through the tie bars 10 which extend through the wall panels and a substantial distance into the floor/ceiling panels of the building, providing a significant reinforcement of the building against disproportionate collapse.

It is important that the support framework is erected precisely, with extreme care being taken to establish the accuracy of the vertical and horizontal alignment and the exact spacing apart of the channels to fit the size of the external structural panels. Unfortunately it has been shown that in many existing tower block buildings, especially those of large panel system construction which use hollow floor/ceiling panels, the layout of the core holes in the floor/ceiling panels can vary from panel to panel, and even in the same building the core holes in the floor/ceiling panels may not be evenly spaced. The result is that when the tie bar anchorage is complete, the projecting threaded end portions of the tie bars may not be in a sufficiently consistent array of locations for the precise alignment of the horizontal and vertical rails of the support framework which is to be attached to them even when the adjustment means of FIGS. 14*b* to 14*d* are used. In such circumstances the vertical and horizontal PFC rails of the support framework may be positioned and adjusted using fixing plates and locking plates which are drilled on-site to establish accurate positioning.

For example, for on-site positioning of the horizontal rails of the support framework, the horizontal rails may be provided with elongate slots (drilled or milled on-site if necessary to correspond to the actual positioning of the projecting threaded end portions of the tie bars) through which the projecting threaded end portions of the tie bars extend, the size and location of those elongate slots being sufficient to permit accurate adjustment and ultimate positioning of the horizontal rails. The horizontal rails, when positioned accurately, are attached to those projecting threaded ends of the tie bars by locking plates tightened against the horizontal rails by nuts threaded onto the tie bar projecting ends and tightened to a desired torque rating. If desired the locking plates may be provided with dowel anchors or set screws which are located in holes drilled on-site into the horizontal rails, for more secure connection to the horizontal rails after the nuts have been tightened.

The on-site positioning of the vertical rails, which may extend the height of one or more floors, of the support framework may be adjusted and the final positioning established by having vertical fixing plates positioned behind or on top of the horizontal rails between the horizontal rails and the external wall of the building. Each vertical fixing plate is provided with an elongate slot through which the projecting threaded end of the tie bar passes, so that the vertical fixing plate can be moved vertically to a desired precise level. When the nuts threaded onto the projecting ends of the tie bars are tightened to the desired torque rating, that clamps the horizontal rails between the fixing plates and the locking plates and also draws the vertical fixing plates into firm and secure contact with the outer face of the building and at the desired adjustment height. The vertical fixing plates project out above and below the horizontal rails so as to provide projecting portions to which the vertical rails are bolted.

The vertical rails of the support structure may then be bolted onto the projecting portions of the vertical fixing plates using bolt holes pre-drilled into the vertical fixing plates or holes drilled on-site. Additional vertical fixing plates may if desired be bolted to the fronts of the vertical rails to connect together vertical rails above and below the horizontal rails, again using pre-drilled bolt holes or bolt holes drilled on-site, or a combination of pre-drilled and on-site drilled holes. Alternatively, the additional fixing plates may be welded to the fronts of the vertical rails. The provision of vertical fixing plates both in front of and behind the horizontal channels means that there is a very secure connection between the vertical and horizontal rails of the support framework. The framework may be assembled from the top down or from the bottom up, or from a mid-section of the building.

Another use of fixing plates and locking plates to position and adjust the vertical and horizontal PFC rails of the support framework would be to proceed as outlined above but with the elongate slots drilled or milled into the vertical rails and the horizontal rails bolted to the fixing plates. In such an inversion of the above described use of fixing plates and locking plates the fixing plates would be horizontal or vertical fixing plates projecting out on either side of the vertical rails so as to provide projecting portions to which the horizontal rails are bolted. That may create a final support framework in which the vertical rails are set away from the face of the building by a small space of perhaps 10 mm, in which case support pads are preferably at spaced intervals to bridge the gap between the vertical rails and the face of the building.

Both the horizontal and vertical rails of the support framework are thus capable of precise and accurate adjustment even though the projecting threaded ends of the tie bars may be out of alignment with the external frame, while the fact that the tie bars extend for some considerable distance through the wall panels and into the floor/ceiling panels creates the significant reinforcement of the building against disproportionate collapse.

The external frame should be designed following an intrusive investigation carried out by a structural engineer or other suitably qualified person who will carry out tests and will assess the condition of the building and also the internal floor and the external wall panels.

Following the completion of this assessment the design of the internal anchors and floor slab reinforcement can be finalised and this will include preparing a specification for the size and shape and layout of the steel members so that the support frame is also a structural restraint frame that will act to contain and support the panels that may be masonry or concrete or other construction material in the event of an internal explosion all according to the parameters and rules laid down in current legislation.

Steel, aluminium or any other suitable material may be used to form the frame and for example the cross section shape of the members may also include for Square (SHS), Rectangular (RHS), Round (CHS), Parallel Flange Channel (PFC) Unequal or Equal Angle, T Section, Z section or special formed or extruded section.

Finally External Wall Insulation (EWI) (a non-flammable product should be specified) is attached to the external support frame in order to enclose the building in a thick layer of insulation, for example a 110-150 mm layer of mineral wool slabs may be cut to size to fit between and over the vertical rails where they may be fastened to the building before they are covered with a layer of render, or suitable cladding or rain screening material.

Although exemplary embodiments have been described in the preceding paragraphs, it should be understood that various modifications may be made to those embodiments without departing from the scope of the appended claims. Thus, the breadth and scope of the claims should not be limited to the above-described exemplary embodiments.

Any combination of the above-described features in all possible variations thereof is encompassed by the present disclosure unless otherwise indicated herein or otherwise clearly contradicted by context.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

The invention claimed is:

1. A method of securing external wall insulation (EWI) panels to outer walls of a high rise concrete frame building, which comprises:

creating continuous passages through outer load-bearing wall panels of the building into adjacent floor/ceiling panels, each such passage forming a tie bar anchorage hole extending at least 300 mm into the adjacent floor/ceiling panel;

inserting into each tie bar anchorage hole a tie bar which has at an inner end portion an anchorage received in the associated tie bar anchorage hole and which has at an outer end portion an externally screw-threaded portion which projects from the outer load-bearing wall panel;

locating a pattress plate at an outer end of each tie bar anchorage hole, with the externally screw-threaded outer end portion of each tie bar extending through an aperture in the associated pattress plate, and securing the pattress plates in position in or against the outer load-bearing wall panels;

anchoring each tie bar in its tie bar anchorage hole by extruding a grouting compound past the associated pattress plate or through an eccentric grout hole in the associated pattress plate and into the outer end of each tie bar anchorage hole around the tie bar, and allowing the grouting compound to set;

securing to the externally screw-threaded outer end portions of the tie bars a metal framework for supporting external wall insulation for the building; and securing to the metal framework EWI panels to clad the building.

2. The method according to claim 1, wherein the building is a building of large panel system construction.

3. The method according to claim 1, wherein the floor/ceiling panels adjacent to the outer load-bearing wall panels of the building are solid concrete panels, and the step of creating continuous passages through the outer load-bearing wall panels of the building into the adjacent floor/ceiling panels comprises drilling core holes through the load-bearing wall panels and into the floor/ceiling panels to create a depth of the tie bar anchorage holes.

4. The method according to claim 1, wherein the floor/ceiling panels adjacent to the outer load-bearing wall panels of the building are precast concrete panels having internal voids preformed therein, and wherein the step of creating continuous passages through the outer load-bearing wall panels of the building into the adjacent floor/ceiling panels comprises drilling core holes through the load-bearing wall panels to connect with the internal voids or with some of the internal voids, and, if necessary, extending the core holes into the floor/ceiling panels to create a depth of the tie bar anchorage holes.

5. The method according to claim 4, wherein a preliminary step in the method is provided and comprises identifying, from the outside of the building, the location of the internal voids.

6. The method according to claim 5, wherein the preliminary step comprises establishing an approximate location of at least one of the internal voids in the outermost floor/ceiling panels of the building by X-ray scanning.

7. The method according to claim 5, wherein the preliminary step comprises establishing the precise location of at least one of the internal voids in the outermost floor/ceiling panels of the building by drilling one or more pilot holes through the outer wall panels of the building until the precise location of the internal void or the internal voids in the adjacent floor/ceiling panels is or are identified.

8. The method according to claim 4, further comprising placing alongside but spaced from each tie bar within the internal voids of the hollow floor/ceiling panels one or more reinforcing bars which become encased in the grouting compound when the grouting compound is injected into the floor/ceiling panel voids which provide the tie bar anchorage holes.

9. The method according to claim 1, wherein, in the step of creating continuous passages through the outer load-bearing wall panels into the adjacent wall/ceiling panels to form the tie bar anchorage holes, each continuous passage commences with a drilling of a pattress core hole partially through the outer wall panel from the outside of the building followed by a drilling of a smaller diameter core hole from a base of the pattress core hole through a remainder of the outer load-bearing wall panel to connect with internal voids in the floor/ceiling panels, and, in the step of locating a pattress plate at the outer end of each tie bar anchorage hole, each pattress plate is a cylindrical pattress plate which is received as a close fit in its associated pattress core hole in the outer load-bearing wall panel, abutting the outer load-bearing wall panel at a shoulder formed between the inner end of the pattress core hole and the associated smaller diameter hole.

10. The method according to claim 9, wherein the floor/ceiling panels adjacent to the outer load-bearing wall panels of the building are precast concrete panels having internal voids preformed therein, and wherein the step of creating continuous passages through the outer load-bearing wall panels of the building into the adjacent floor/ceiling panels comprises drilling core holes through the load-bearing wall panels to connect with the internal voids or with some of the internal voids, and, if necessary, extending the core holes into the floor/ceiling panels to create a depth of the tie bar anchorage holes, and wherein the pattress core holes extend coaxially with the internal voids in the floor/ceiling panels.

11. The method according to claim 1, wherein each tie bar anchorage hole extends at least three meters into the respective floor/ceiling panel.

12. The method according to claim 11, wherein each tie bar anchorage hole extends at least four meters into the respective floor/ceiling panel.

13. The method according to claim 1, wherein the anchorage of each tie bar comprises a washer secured to the inner end portion of the tie bar, the washer having a size and shape substantially the same as those of the tie bar anchorage hole in which it is received.

14. The method according to claim 1, wherein a tubular fabric sleeve is placed around at least the anchorage end portion of each respective tie bar before the respective tie bar is inserted into the respective tie bar anchorage hole, and the grouting compound is extruded into the tie bar anchorage holes between the tie bars and the associated sleeves so that the grouting compound expands the sleeves and, on permeating through the fabric of the sleeves, bonds to the concrete of the associated floor/ceiling panel.

15. The method according to claim 1, wherein the metal framework comprises an array of vertical rails carried by anchorage brackets secured fast against the pattress plates by nuts screwed onto the externally screw-threaded outer portions of the tie bars, and an array of horizontal rails attached to the vertical rails.

16. The method according to claim 1, wherein the metal framework comprises an array of vertical rails carried by anchorage brackets formed integrally with the pattress plates, and an array of horizontal rails attached to the vertical rails.

17. The method according to claim 15, wherein each vertical rail comprises a pair of generally U-shaped cold rolled steel sections clamped back to back against opposite sides of flange portions of the anchorage brackets.

* * * * *